US011969094B2

(12) United States Patent
Schmitz et al.

(10) Patent No.: US 11,969,094 B2
(45) Date of Patent: Apr. 30, 2024

(54) CHAIR

(71) Applicant: MillerKnoll, Inc., Zeeland, MI (US)

(72) Inventors: Johann Burkhard Schmitz, Berlin (DE); Carola Zwick, Berlin (DE); Roland Zwick, Berlin (DE)

(73) Assignee: Millerknoll, Inc., Zeeland, MI (US)

( * ) Notice: Subject to any disclaimer, the term of this patent is extended or adjusted under 35 U.S.C. 154(b) by 3 days.

(21) Appl. No.: 17/617,390

(22) PCT Filed: Jun. 11, 2020

(86) PCT No.: PCT/US2020/037276
§ 371 (c)(1),
(2) Date: Dec. 8, 2021

(87) PCT Pub. No.: WO2020/252191
PCT Pub. Date: Dec. 17, 2020

(65) Prior Publication Data

US 2022/0248853 A1 Aug. 11, 2022

(30) Foreign Application Priority Data

Jun. 11, 2019 (DE) ..... 10 2019 115 842.7
Jun. 11, 2019 (DE) ..... 10 2019 115 847.8

(51) Int. Cl.
*A47C 3/12* (2006.01)
*A47C 1/032* (2006.01)
(Continued)

(52) U.S. Cl.
CPC ..... *A47C 1/032* (2013.01); *A47C 3/12* (2013.01); *A47C 7/44* (2013.01); *A47C 5/12* (2013.01)

(58) Field of Classification Search
CPC ..... A47C 3/12; A47C 5/12; A47C 7/44
(Continued)

(56) References Cited

U.S. PATENT DOCUMENTS 2,343,077 A 2/1944 Parrish
D183,416 S 8/1958 Bellmann
(Continued)

FOREIGN PATENT DOCUMENTS

CN 105722433 B 5/2015
DE 202012104761 U1 * 3/2013 ..... A47C 7/44
(Continued)

OTHER PUBLICATIONS

International Search Report with Written Opinion for related Application No. PCT/US2020/037276 dated Sep. 25, 2020 (14 Pages).
(Continued)

*Primary Examiner* — Rodney B White
(74) *Attorney, Agent, or Firm* — MICHAEL BEST & FRIEDRICH LLP

(57) ABSTRACT

A chair includes a base, a receptacle coupled to an upper end of the base, and a seat shell forming a seat surface. The seat shell is supported by the receptacle. The chair also includes a back shell forming a back surface. The back shell is connected to the seat shell on both sides of the seat surface and on both sides of the back surface. The back shell includes an extension extending from the back surface to the receptacle under the seat shell. The extension is elastically deformable.

28 Claims, 22 Drawing Sheets

(51) Int. Cl.
*A47C 5/12* (2006.01)
*A47C 7/44* (2006.01)

(58) Field of Classification Search
USPC ..... 297/285, 296, 325, 326, 327, 340, 341, 297/342, 452.15
See application file for complete search history.

(56) References Cited

U.S. PATENT DOCUMENTS 2,845,699 A 8/1958 Woodard
3,142,514 A * 7/1964 Ginat ..... A47C 7/002 D6/365
D205,939 S 10/1966 Laverne
3,309,136 A * 3/1967 Kehoe ..... A47B 91/08 297/296 X
D209,282 S 11/1967 Boyd et al.
3,361,472 A 1/1968 Hasbrouck
3,669,496 A * 6/1972 Chisholm ..... A47C 7/16 297/452.15 X
D226,648 S 4/1973 Sebel et al.
D227,830 S 7/1973 Klose et al.
D230,670 S 3/1974 Begge
4,054,317 A 10/1977 Stumpf et al.
D276,956 S 1/1985 Aronowitz et al.
D279,246 S 6/1985 Murry
4,529,247 A * 7/1985 Stumpf ..... A47C 7/14 297/285
4,557,521 A * 12/1985 Lange ..... A47C 7/445 297/285
4,580,836 A * 4/1986 Verney ..... A47C 7/445 297/452.15 X
4,585,272 A * 4/1986 Ballarini ..... A47C 3/12 297/285
4,653,806 A 3/1987 Willi
4,744,603 A * 5/1988 Knoblock ..... A47C 3/12 297/285
4,892,356 A * 1/1990 Pittman ..... A47C 3/12 297/452.15 X
4,981,326 A * 1/1991 Heidmann ..... A47C 7/441 297/285
5,029,940 A 7/1991 Golynsky et al.
5,050,931 A * 9/1991 Knoblock ..... A47C 3/245 297/285
5,102,196 A * 4/1992 Kaneda ..... A47C 3/12 297/285
5,106,157 A 4/1992 Nagelkirk et al.
5,318,346 A * 6/1994 Roossien ..... A47C 3/12 297/452.15 X
5,333,368 A * 8/1994 Kriener ..... A47C 7/444 297/302.1 X
5,333,934 A * 8/1994 Knoblock ..... A47C 1/03255 297/452.15 X
5,352,022 A 10/1994 Knoblock
5,411,316 A * 5/1995 Lovegrove ..... A47C 7/44 297/452.15 X
D368,608 S 4/1996 Stirling et al.
5,538,326 A * 7/1996 Lorbiecki ..... A47C 3/12 297/452.15 X
5,540,481 A * 7/1996 Roossien ..... A47C 3/12 297/300.4
5,577,811 A * 11/1996 Ogg ..... A47C 3/12 297/452.15 X
5,599,069 A * 2/1997 Lorbiecki ..... A47C 5/12 297/452.15 X
5,601,336 A * 2/1997 Troyas-Bermejo ..... A47C 1/03272 297/316
5,662,381 A * 9/1997 Roossien ..... A47C 3/12 297/301.1
5,725,277 A 3/1998 Knoblock
5,765,914 A 6/1998 Britain et al.
5,806,930 A * 9/1998 Knoblock ..... A47C 1/03255 297/302.1 X
5,842,264 A * 12/1998 Roossien ..... A47C 3/12 297/440.22
5,904,397 A * 5/1999 Fismen ..... A47C 7/405 297/297
5,951,109 A 9/1999 Roslund, Jr. et al.
D417,795 S 12/1999 Rashid
6,425,633 B1 7/2002 Wilkerson et al.
6,428,099 B1 8/2002 Kain
6,609,755 B2 8/2003 Koepke et al.
6,820,936 B2 11/2004 Wilkerson et al.
6,896,328 B2 * 5/2005 Goodworth ..... A47C 7/54 297/297
6,945,602 B2 9/2005 Fookes et al.
D513,902 S 1/2006 Piretti
D518,968 S 4/2006 Magnani et al.
D525,445 S 7/2006 Liu et al.
D525,446 S 7/2006 Farber
7,118,177 B2 * 10/2006 Piretti ..... A47C 7/44 297/285
D535,838 S 1/2007 Ritch et al.
D546,085 S 7/2007 Ritch et al.
D546,087 S 7/2007 Rashid
D548,475 S 8/2007 Ritch et al.
D553,380 S 10/2007 Natuzzi
D555,380 S 11/2007 Farber
D557,916 S 12/2007 Dietrich
7,416,251 B2 * 8/2008 Chu ..... A47C 7/448 297/285
7,422,284 B2 * 9/2008 Hartenstine ..... A47D 13/10 297/452.15 X
D588,371 S 3/2009 Picco et al.
7,500,718 B2 3/2009 Fookes
7,503,626 B2 3/2009 Maier et al.
D596,871 S 7/2009 Farber
D648,553 S 11/2011 Wilson et al.
D648,946 S 11/2011 Wilson et al.
D649,801 S 12/2011 Salto
D657,583 S 4/2012 Wilson et al.
D667,243 S 9/2012 Su
8,282,172 B2 * 10/2012 Schmitz ..... A47C 1/03288 297/452.15 X
D678,690 S 3/2013 Eldoy
D679,525 S 4/2013 Corcorran et al.
8,414,073 B2 * 4/2013 Schmitz ..... A47C 1/03288 297/302.1 X
D705,587 S 5/2014 Caruso
8,899,678 B2 12/2014 Doolan et al.
D726,468 S 4/2015 McKenna et al.
8,998,318 B2 4/2015 Gaudreau, Jr.
D738,657 S 9/2015 Robins et al.
D741,615 S 10/2015 Morrison
D742,132 S 11/2015 Morrison
D742,675 S 11/2015 Morrison
9,364,091 B2 6/2016 Costaglia
D763,612 S 8/2016 Goetz
9,402,478 B2 8/2016 Hasegawa et al.
9,462,889 B2 * 10/2016 Piretti ..... A47C 1/03255
D787,248 S 5/2017 Jahns
10,016,061 B2 * 7/2018 Brueske ..... A47C 7/462
10,021,984 B2 * 7/2018 Ludwig ..... A47C 3/12
10,167,083 B2 1/2019 Henshaw
10,194,750 B2 * 2/2019 Ludwig ..... A47C 1/03277
10,427,762 B1 * 10/2019 Mosher ..... B63B 29/06
10,449,876 B2 10/2019 Lonstein et al.
10,485,727 B2 * 11/2019 Grove ..... A47C 7/467
10,531,738 B2 1/2020 Schmitz et al.
10,820,703 B2 * 11/2020 Maier ..... A47C 1/03277
10,893,751 B2 * 1/2021 Dennehy ..... A47C 7/44
D915,096 S 4/2021 Li
10,966,527 B2 * 4/2021 Deevers ..... A47C 3/12
11,096,497 B2 * 8/2021 Ludwig ..... A47C 3/18
D931,639 S 9/2021 Ojerstam
11,134,780 B2 * 10/2021 Maier ..... A47C 7/44
D939,230 S 12/2021 Hayon
11,259,637 B2 * 3/2022 Ludwig ..... A47C 3/20
D970,912 S 11/2022 Schmitz et al.
11,553,797 B2 * 1/2023 Ludwig ..... A47C 7/16
11,832,734 B2 * 12/2023 Weber ..... A47C 7/441

(56) References Cited

U.S. PATENT DOCUMENTS

| | | | | |
|---|---|---|---|---|
| 2003/0052521 | A1 | 3/2003 | Nelson et al. | |
| 2011/0193384 | A1 | 8/2011 | Ni | |
| 2012/0086251 | A1* | 4/2012 | Parker | A47C 7/445 297/285 |
| 2013/0038110 | A1* | 2/2013 | Deisig | A47C 3/045 297/354.12 |
| 2014/0062154 | A1* | 3/2014 | Minino | A47C 7/445 297/301.1 |
| 2015/0223605 | A1 | 8/2015 | Piretti | |
| 2016/0128483 | A1 | 5/2016 | Gorgi | |
| 2016/0143443 | A1* | 5/2016 | Roslund, Jr. | A47C 7/025 297/299 |
| 2018/0125245 | A1 | 5/2018 | Ludwig et al. | |
| 2018/0125246 | A1 | 5/2018 | Ludwig et al. | |
| 2018/0295996 | A1 | 10/2018 | Ludgwig et al. | |
| 2021/0177149 | A1* | 6/2021 | Deevers | A47C 5/12 |
| 2021/0345781 | A1* | 11/2021 | Ludwig | A47C 7/16 |

FOREIGN PATENT DOCUMENTS

| | | | | |
|---|---|---|---|---|
| EP | 0268746 | B1 | 6/1990 | |
| EP | 678260 | A1 * | 10/1995 | A47C 3/12 |
| EP | 0796577 | A1 * | 9/1997 | A47C 7/44 |
| EP | 1854378 | A1 * | 11/2007 | A47C 7/44 |
| EP | 2110051 | A1 * | 10/2009 | A47C 31/023 |
| EP | 3217845 | B1 | 9/2018 | |
| EP | 3556252 | A1 | 10/2019 | |
| JP | 2016036641 | A | 3/2016 | |
| KR | 20120118575 | A * | 10/2012 | A47C 7/44 |
| WO | WO-2009039231 | A2 * | 3/2009 | A47C 1/03255 |
| WO | WO2009090769 | A1 | 7/2009 | |
| WO | WO2017135831 | A1 | 8/2017 | |
| WO | WO2019201608 | A1 | 10/2019 | |

OTHER PUBLICATIONS

Registered Community Design by EUIPO, No. CD002847095-0001, Published Nov. 18, 2015 (6 Pages).

ETA Deutschland, "AKTION 2000", HD13004066 design of a chair, received from the JPO on Jan. 12, 2001 (2 Pages).

Design of a chair shown in Contract, published by Vnu Business Publications, No. HD24003919, received by the JPO Jul. 17, 2012 (2 Pages).

Extended European Search Report for Application No. 20823034.2 dated Jun. 5, 2023 (6 pages).

Chinese Patent Office Action for Application No. 202080042699.1 dated Feb. 7, 2024 (26 pages including English translation).

* cited by examiner

CHAIR

FIELD OF THE INVENTION

The present invention relates to chairs.

SUMMARY

In one embodiment, the invention provides a chair including a base, a receptacle coupled to an upper end of the base, and a seat shell forming a seat surface. The seat shell is supported by the receptacle. The chair also includes a back shell forming a back surface. The back shell is connected to the seat shell on both sides of the seat surface and on both sides of the back surface. The back shell includes an extension extending from the back surface to the receptacle under the seat shell. The extension is elastically deformable.

In another embodiment, the invention provides a chair including a base defining a vertical axis, a receptacle coupled to an upper end of the base, a seat shell forming a seat surface and a bottom surface, and a back shell forming a back surface. The back shell includes an extension extending from the back surface to the receptacle under the seat shell. The chair also includes a tilt housing secured to the bottom surface of the seat shell. Either the receptacle or the tilt housing includes a first pin and a second pin. The first pin is positioned adjacent a forward end thereof. The second pin positioned adjacent a rearward end thereof. Another of the receptacle or the tilt housing defines a first track that receives the first pin and a second track that receives the second pin. The first track extends along a first longitudinal axis that is oriented at a first angle relative to the vertical axis. The second track extends along a second longitudinal axis that is oriented at a second angle relative to the vertical axis. The second angle is different than the first angle.

In another embodiment the invention provides a chair including a base and a receptacle coupled to an upper end of the base. The receptacle includes a first pin adjacent a first end thereof and a second pin adjacent a second end thereof. The chair also includes a seat shell forming a seat surface and a bottom surface, and a back shell forming a back surface. The back shell includes an extension integrally formed as a single piece with the back surface and extending from the back surface to the receptacle under the seat shell. The extension is elastically deformable. The chair also includes a first lateral connecting strut spaced apart from the extension and connecting a first side of the seat shell to a first side of the back shell, a second lateral connecting strut spaced apart from the extension and connecting a second side of the seat shell to a second side of the back shell, and a tilt housing secured to the bottom surface of the seat shell. The tilt housing has a first track that receives the first pin and a second track that receives the second pin. The first track extends along a first longitudinal axis that is oriented at a first angle relative to the vertical axis. The second track extends along a second longitudinal axis that is oriented at a second angle relative to the vertical axis. The second angle is different than the first angle. The seat shell is movable relative to the back shell along a path defined by the first track and the second track.

Other aspects of the invention will become apparent by consideration of the detailed description and accompanying drawings.

DETAILED DESCRIPTION

Figure 1:
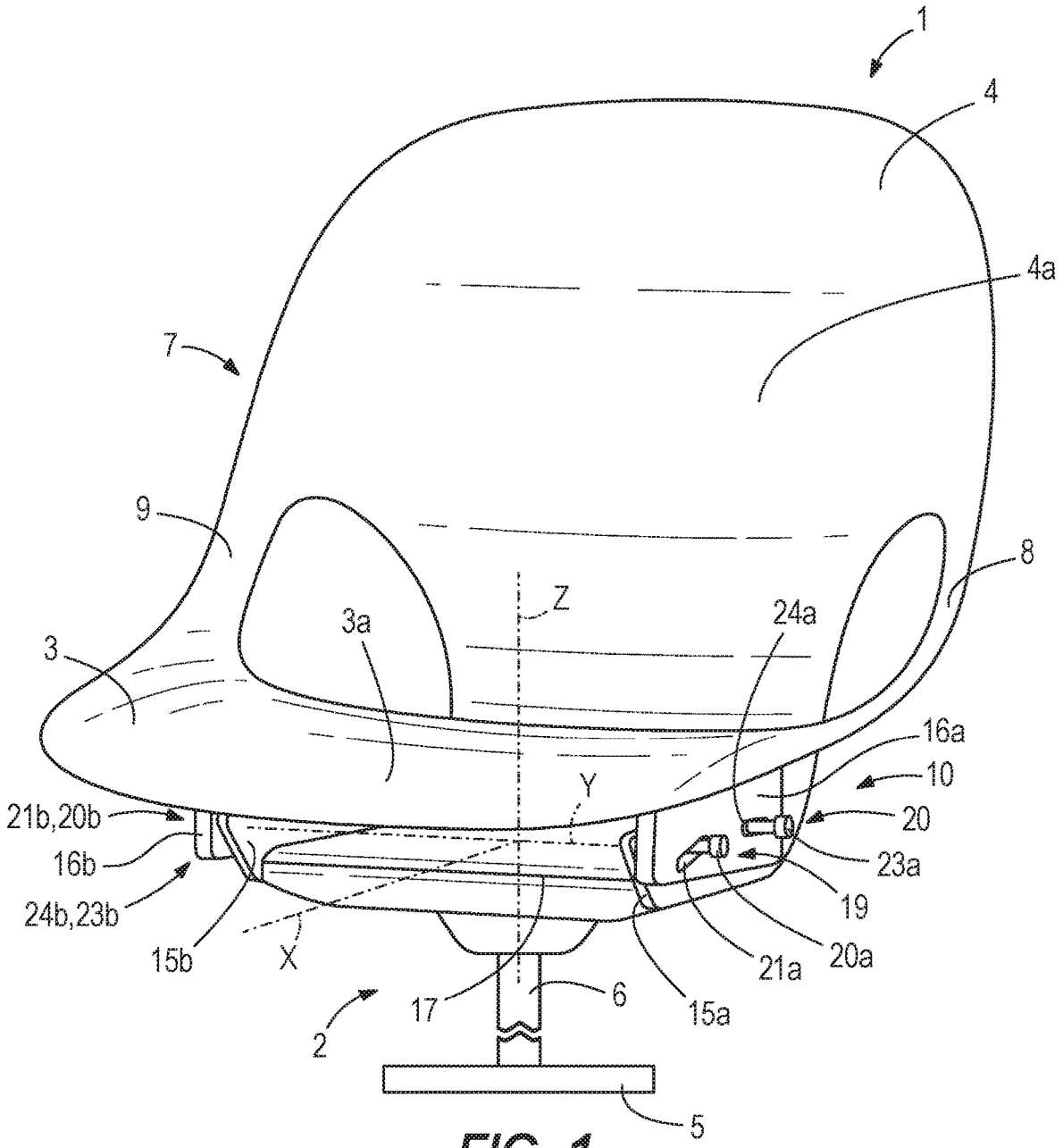
FIG. 1 is a perspective view of a chair according some embodiments.
Figure 2:
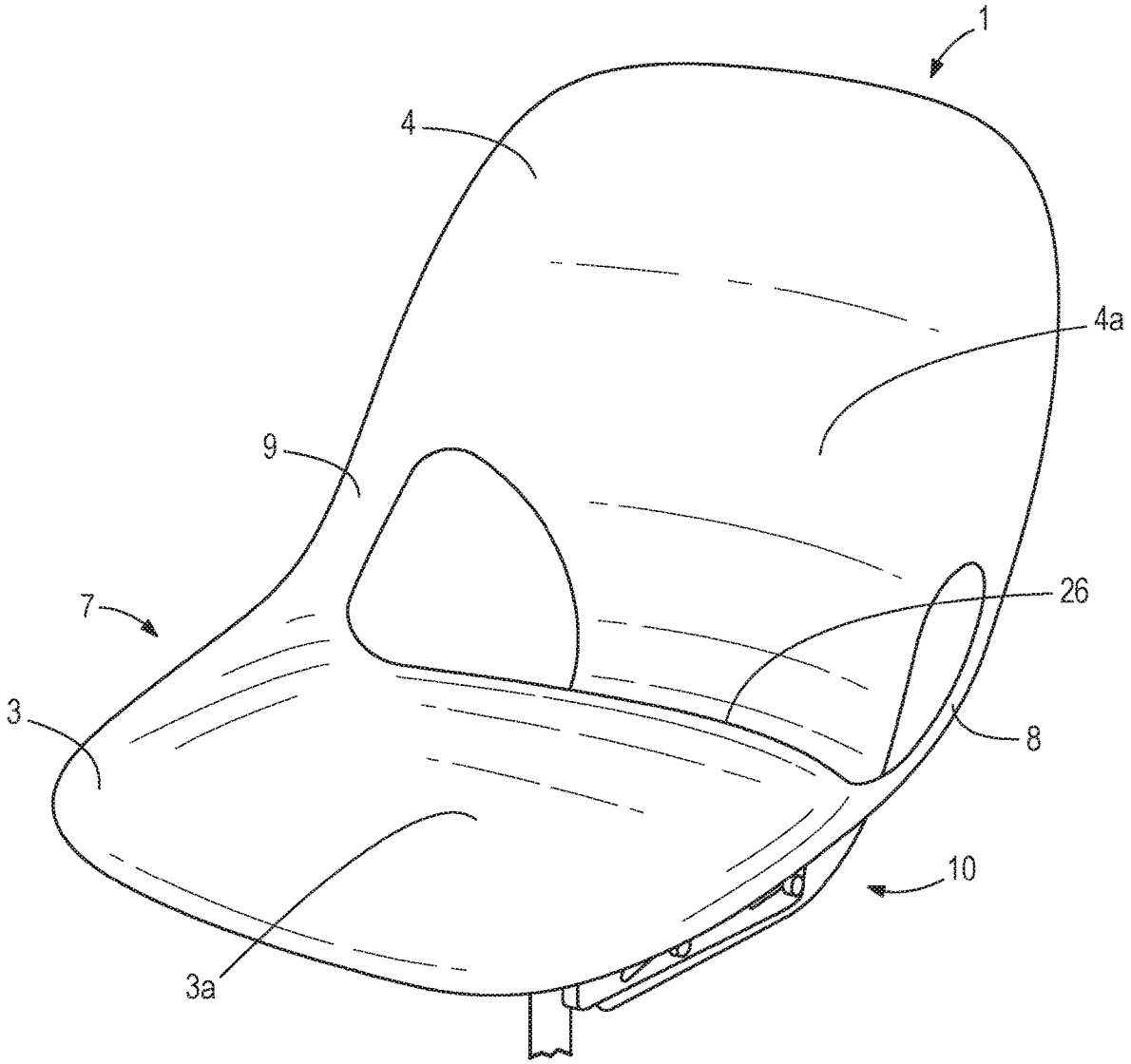
FIG. 2 is a further perspective view of the chair shown in FIG. 1.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

FIGS. 1-5 illustrate a chair 1. The chair 1 includes a base 2, a seat shell 3 and a back shell 4. The base 2 includes a foot 5 and a supporting pillar 6. The seat shell 3 and the back shell 4 are designed as an integrally formed supporting element 7. In the illustrated embodiment, the seat shell 3 and the back shell 4 are connected by two lateral connecting struts 8, 9. The connecting struts 8, 9 run on both sides of a seat surface 3*a* formed by the seat shell 3 and on both sides of a back surface 4*a* formed by the back shell 4. The back shell 4 includes an extension 10 which extends under the seat shell 3 (see in particular FIGS. 3 and 4). A bore 11 is formed in the extension 10. A head 6*a* of the carrying pillar 6 is accommodated by the bore 11 (see FIG. 3). The illustrated bore 11 tapers conically from a lower side 10*b* of the extension 10.

The seat shell 3 forms a first free end 13 of the supporting element 7. The extension 10 of the back shell 4 forms a second, free end 14 of the supporting element 7.

The extension 10 includes a lower guide component 15. The lower guide component 15 may also be referred to as a receptacle. The lower guide component 15 is stationary in relation to the base 2. The lower guide component 15 also includes the bore 11 that receives the head 6*a* of the carrying pillar 6. The illustrated lower guide component 15 is formed in one part with the extension 10. The seat shell 3 includes an upper guide component 16. The upper guide component 16 may also be referred to as a tilt housing. The illustrated upper guide component 16 is formed in one part with the seat shell 3.

As shown in FIG. 1, the lower guide part 15 is formed by two side members 15*a*, 15*b*. The two side members 15*a*, 15*b* are formed laterally on the extension 10, on the left and on the right symmetrically with respect to a longitudinal center axis x of the lower guide part 15. The longitudinal center axis x here is oriented perpendicularly to a vertical axis z, which is the center axis of the base 2 and, more particularly, the carrying pillar 6. The longitudinal center axis x is also intersected perpendicularly by a transverse axis y which runs parallel to a front edge 17 of the extension 10.

As shown in FIG. 1, the upper guide part 16 is formed by two side members 16*a*, 16*b*. The two side members 16*a*, 16*b* are formed on a lower side 18 of the seat shell 3 symmetrically with respect to the longitudinal center axis x. The upper guide component 16 is guided on the lower guide component 15 in a manner movable relative to the lower guide component 15. The lower guide component 15 and the upper guide component 16 are connected to each other via a first, front connecting arrangement 19 and a second, rear connecting arrangement 20.

The first, front connecting arrangement 19 includes two pins 20*a*, 20*b* which are oriented in the direction of the transverse axis y. The left pin 20*a* is connected to the left side member 15*a* of the lower guide component 15. The right pin 20*b* is connected to the right side member 15*b* of the lower guide component 15. The front connecting arrangement 19 furthermore includes two elongated holes 21*a*, 21*b*, or tracks, opening in the direction of the transverse axis y. The left elongated hole 21*a* is formed in the left side member 16*a* of the upper guide component 16. The right elongated hole 21*b* is formed in the right side member 16*b* of the upper guide component 16. The left pin 20*a* is guided through the left elongated hole 21*a* and the right pin 20*b* is guided through the right elongated hole 21*b*.

The second, rear connecting arrangement 22 includes two pins 23*a*, 23*b* which are oriented in the direction of the transverse axis y. The left pin 23*a* is connected to the left side member 15*a* of the lower guide component 15. The right pin 23*b* is connected to the right side member 15*b* of the lower guide component 15. The rear connecting arrangement 22 furthermore includes two elongated holes 24*a*, 24*b*, or tracks, opening in the direction of the transverse axis y. The left elongated hole 24*a* is formed in the left side member 16*a* and the right elongated hole 24*b* is formed in the right side member 16*b* of the upper guide component 16. The left pin 23*a* is guided through the left elongated hole 24*a* and the right pin 23*b* is guided through the right elongated hole 24*b*.

Therefore, the seat shell 3 is guided by the upper guide component 16 on the lower guide component 15 along a path B (see FIG. 5), which is predetermined by the elongated holes 21*a*, 21*b* and 24*a*, 24*b*. The elongated holes 21*a*, 21*b* lie opposite each other in a mirror-inverted manner with respect to the longitudinal axis x. The elongated holes 24*a*, 24*b* lie opposite each other in a mirror-inverted manner with respect to the longitudinal axis x.

The lower guide component 15 and the upper guide component 16 are connected in such a manner that the relative movement of the upper guide component 16 (and, therefore, also the relative movement of the seat shell 3) runs in the form of a sliding and pivoting movement on an arcuate path BB differing from a circular arc path. The lower guide component 15 and the upper guide component 16 together form a movement converter by means of which a spatial orientation of the seat shell 3 is mechanically controlled depending on an inclination of the back shell 4.

In other embodiments, instead of the pins 20*a*, 20*b* and 23*a*, 23*b* on the left side member 15*a* and the right side member 15*b* of the lower guide component 15, two projections may be formed on the lower guide component 15 which are guided in the corresponding elongated holes 21*a*, 21*b* and 24*a*, 24*b* of the upper guide component 16.

In the illustrated embodiment where the supporting element 7 is integrally formed as a single piece, the extension 10 of the back shell 4 is designed to be elastically deformable in a section 25 lying between the receptacle 11 and the back surface 4*a* (see FIG. 3) to permit the seat shell 3 to be displaceable. The supporting element 7 includes the lateral connecting struts 8, 9 as further elastic regions.

In order to produce the arcuate path BB providing seating comfort, the elongated holes 21*a*, 21*b* of the first connecting arrangement 19 are oriented rising in the direction of the back shell 4 and the elongated holes 24*a*, 24*b* of the second connecting arrangement 22 are oriented horizontally in space, namely in the direction of the longitudinal axis x.

Figure 3:
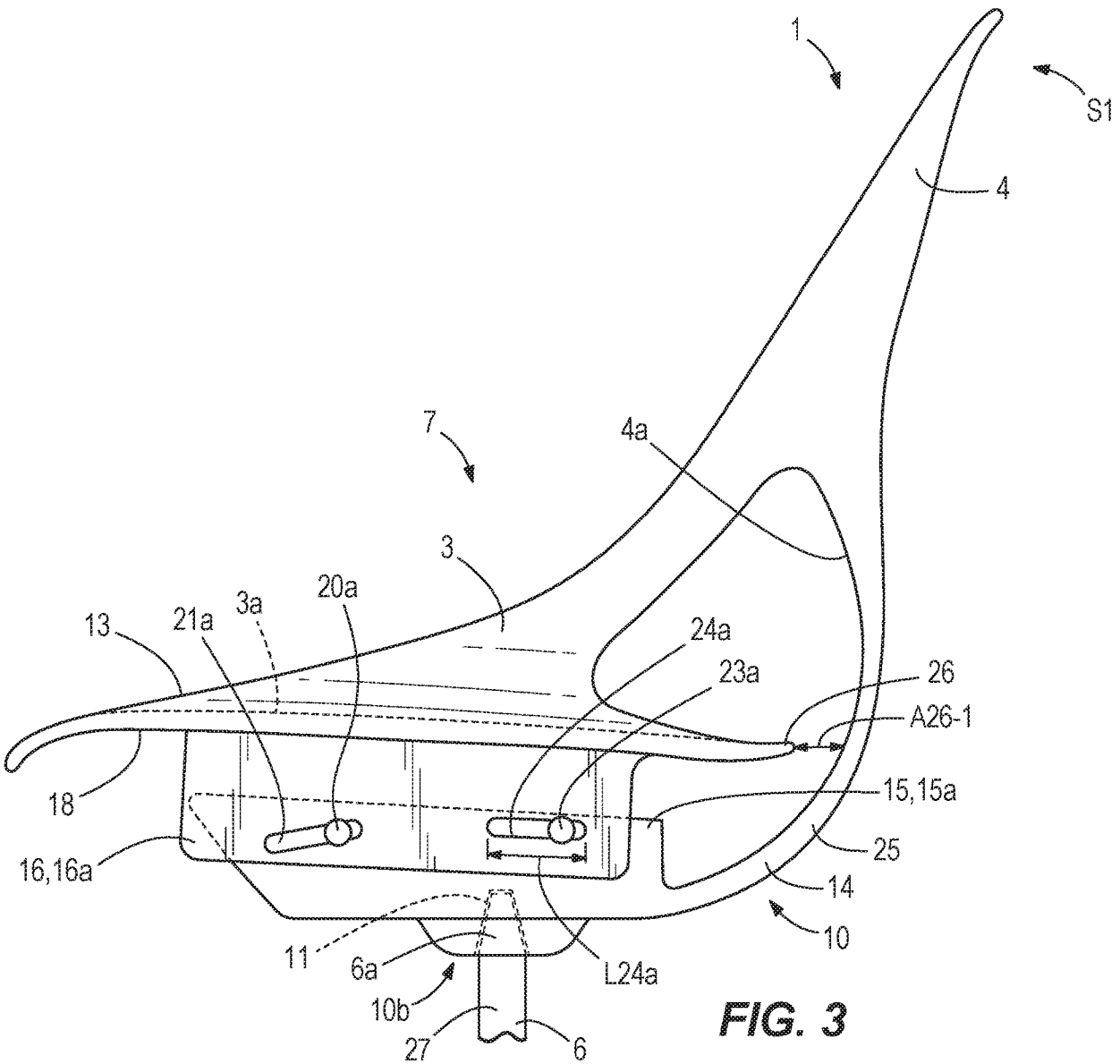
FIG. 3 is a side view of the chair shown in FIG. 1 in an upright position.
Figure 4:
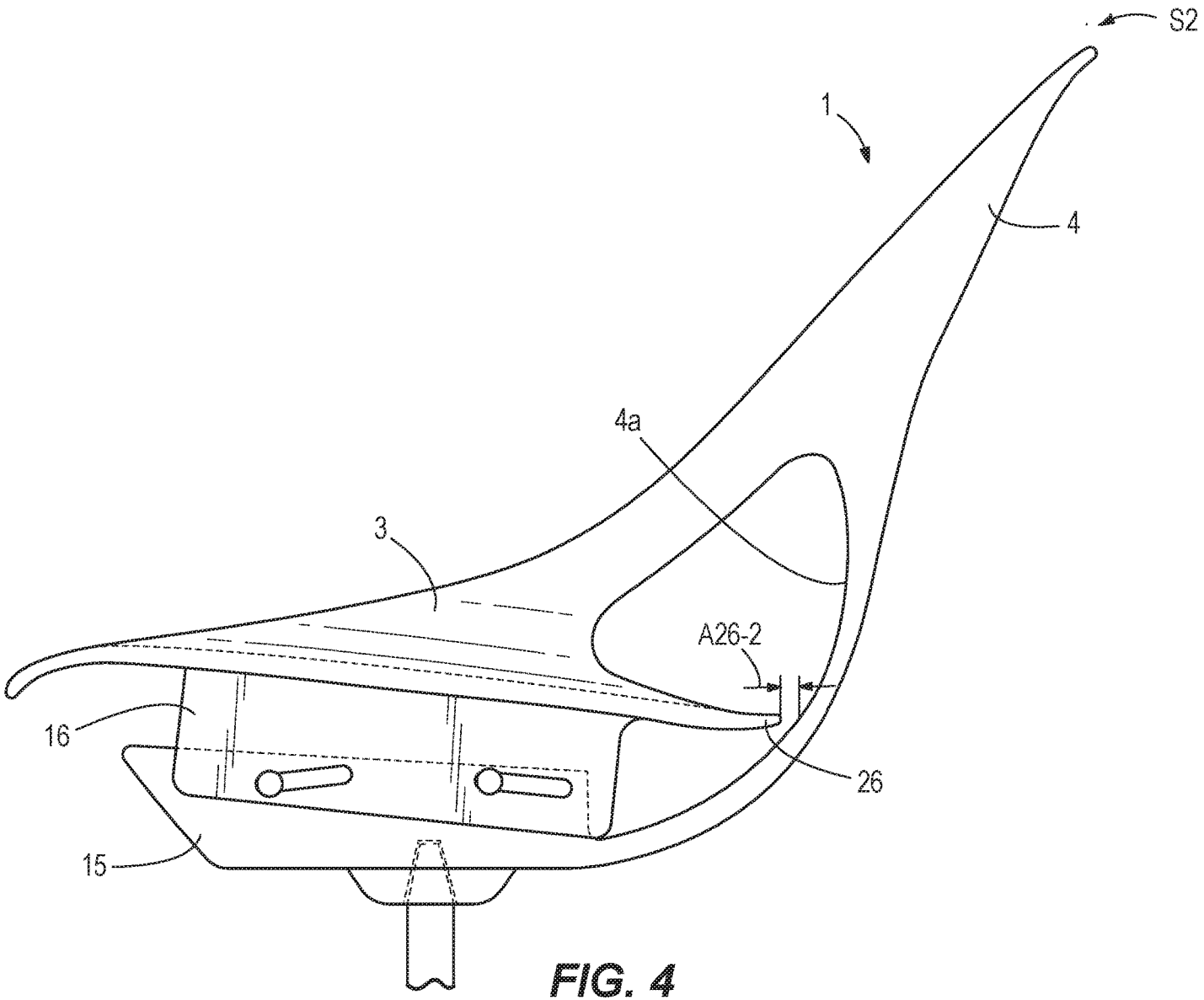
FIG. 4 is a side view of the chair shown in FIG. 1 in a backwardly inclined position.
Figure 5:
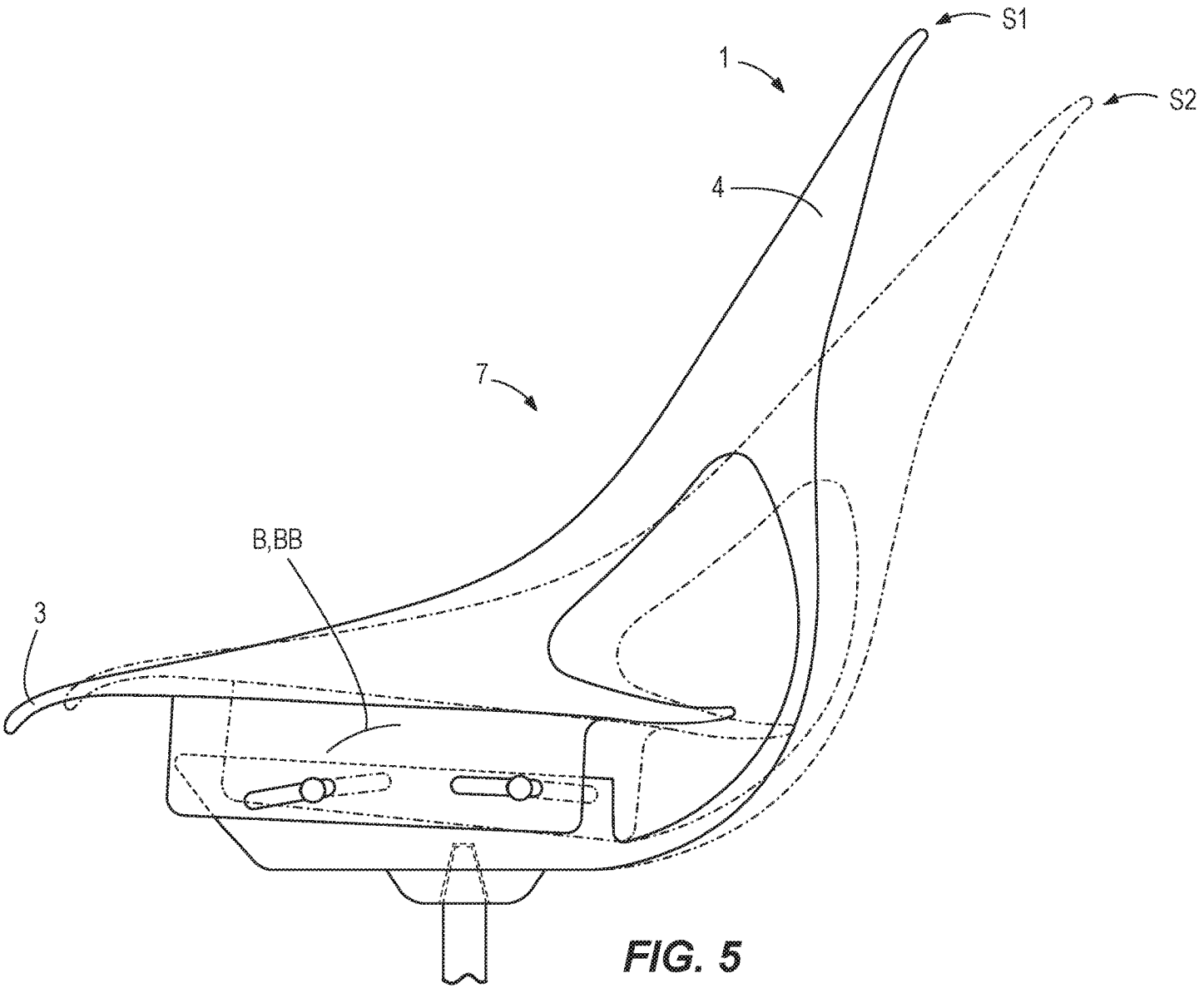
FIG. 5 is a schematic illustration in which the views of FIGS. 3 and 4 are superimposed, with the view of FIG. 3 shown in solid lines and with the view of FIG. 4 shown in dashed lines.

The chair 1 is shown in FIGS. 3 and 5 (illustration with solid lines) with its supporting element 7 in an upright position S1. The chair 1 is shown in FIGS. 4 and 5 (illustration with dashed lines) with its supporting element 7 in a backwardly inclined position S2. In the backwardly inclined position S2 of the chair 1, the supporting element 7 is elastically deformed in such a manner that the supporting element 7 generates a counter force, by means of which the supporting element 7 is moved by itself from its deformed position S2 into an undeformed position. In the undeformed position, the supporting element 7 adopts the upright position S1 of the chair 1. In the backwardly inclined position S2 of the chair 1, the supporting element 7 is elastically deformed in particular in the section 25 of the extension 10 that adjoins a back surface 4*a* of the back shell 4.

FIG. 5 illustrates the views of FIGS. 3 and 4 in superimposed form, with the view of FIG. 3 shown by solid lines and with the view of FIG. 4 shown by dashed lines. In a comparative examination of the upright position S1 of the chair 1 and the backwardly inclined position S2 of the chair 1, it can be seen that the supporting element 7 is deformed in particular at the section 25 of the extension 10 and in regions of the lateral connecting struts 8, 9.

It is also apparent from FIG. 5 that, in the position S2, the seat surface 3*a* is raised in relation to the position S1 in a front region, which is opposite from the back surface 4*a*. In the position S2, the seat surface 3*a* is lowered in a rear region which is close to the back surface 4*a*. Furthermore, an angle enclosed by the seat surface 3*a* and the back surface 4*a* increases by more than 10° in the position S2 than in the position S1. In other words, the back surface 4*a* is reclined or tilted at least 10° relative to the seat surface 3*a* when the supporting element 7 moves from the upright position S1 to the backwardly inclined position S2.

Referring to FIG. 3, a rear edge 26 of the seat shell 3 is spaced a first distance A26-1 from the back surface 4*a* of the back element 4 when in the upright position S1 of the chair 1. Referring to FIG. 4, the rear edge 26 of the seat shell 3 is spaced a second distance A26-2 from the back surface 4*a* of the back element 4 when in the backwardly inclined position S2 of the chair 1. In the illustrated embodiment, the first distance A26-1 is significantly larger than the second distance A26. Furthermore, the first distance A26-1 is greater than or equal to a length L24*a* of a rear elongated hole 24*a*, 24*b* of the second connecting arrangement 22.

The illustrated head 6*a* of the carrying pillar 6 is designed as a cone. The head 6*a* of the carrying pillar 6 is coordinated with the bore 11, which is designed as a conical bore. In some embodiments, the carrying pillar 6 is designed as a gas-filled spring 27. The gas-filled spring 27 allows a height of the supporting element 7 to be adjusted.

Figure 6:
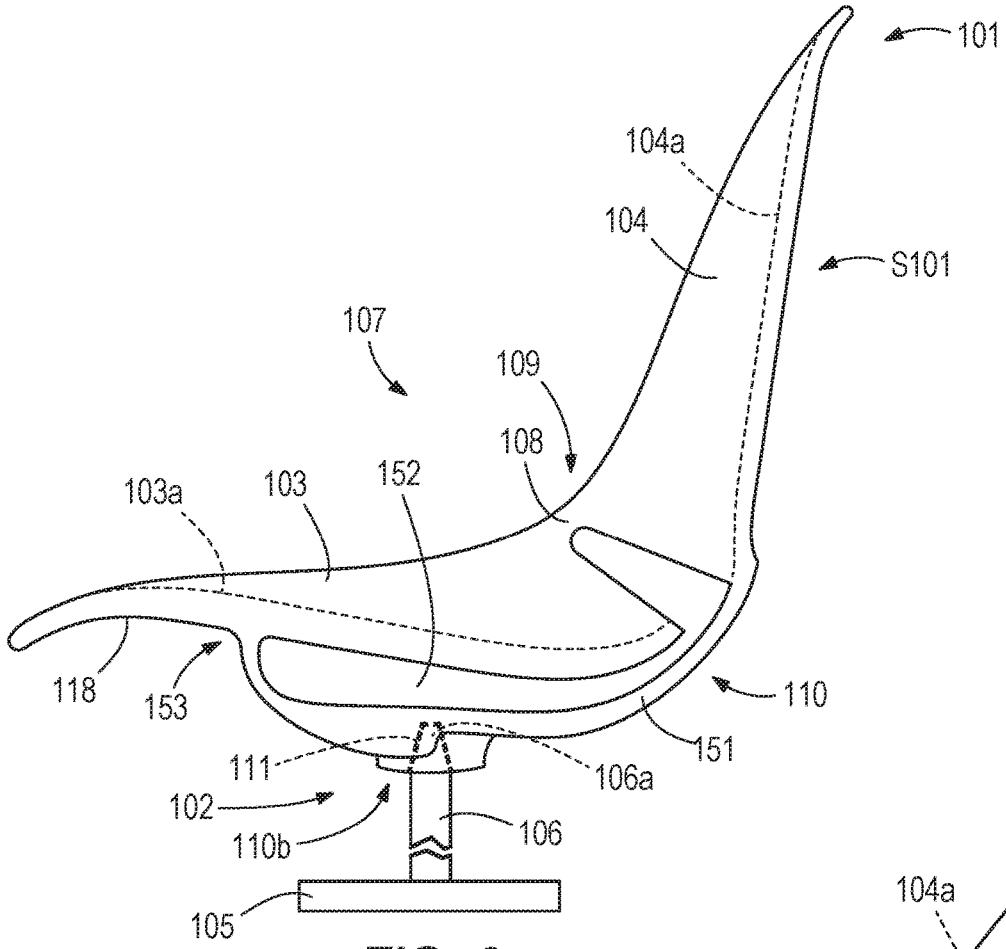
FIG. 6 is a schematic side view of a chair according to some embodiments in an upright position.
Figure 7:
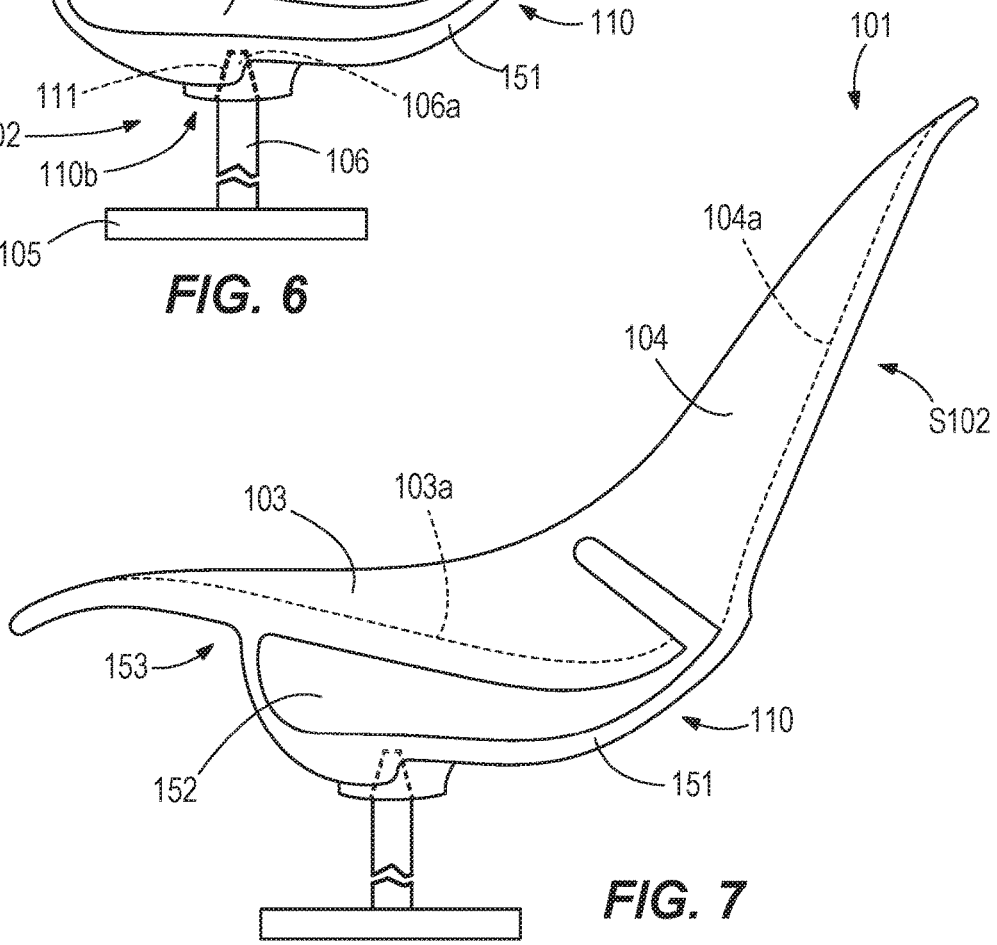
FIG. 7 is a schematic side view of the chair shown in FIG. 6 in a backwardly inclined position.
Figure 8:
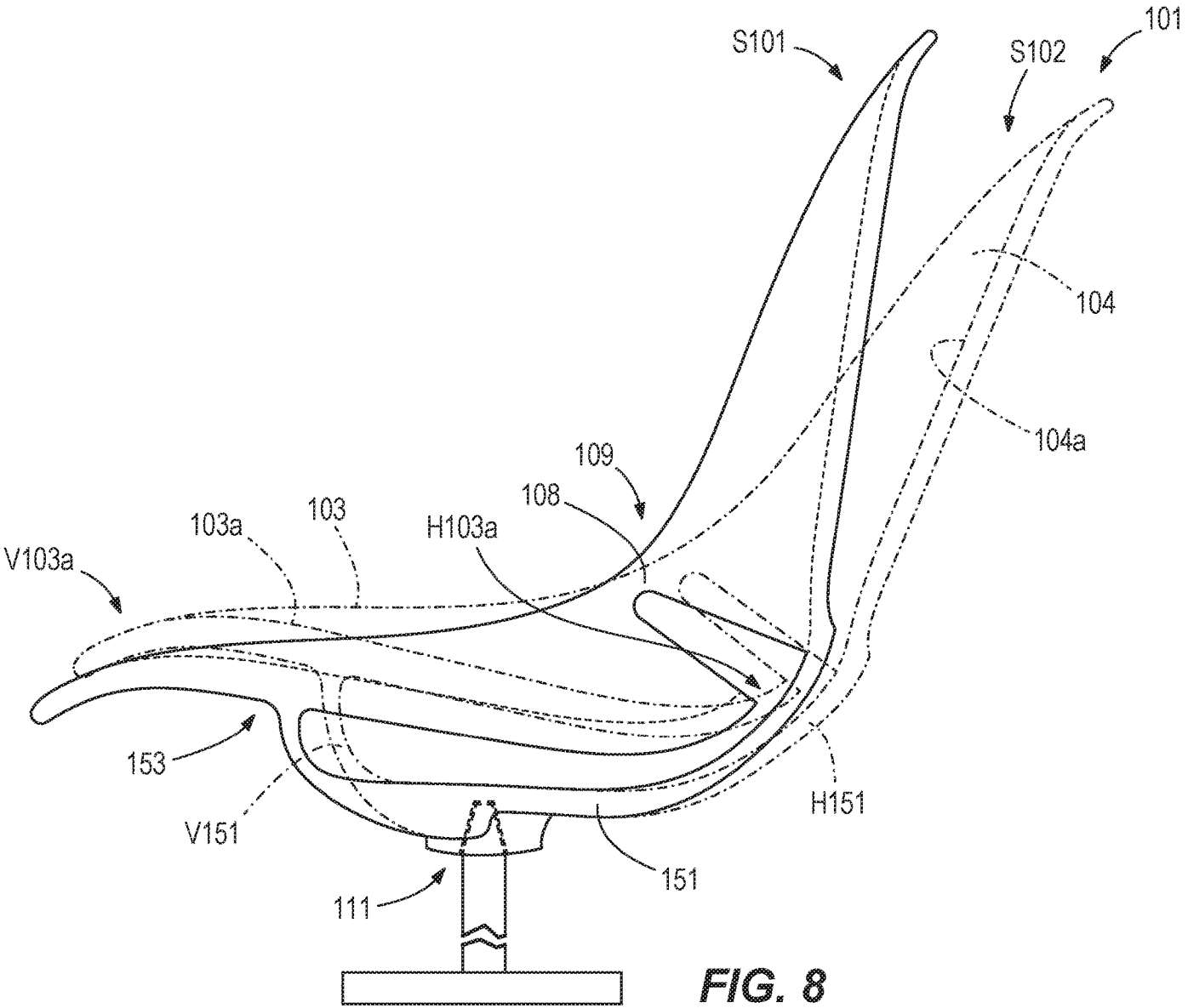
FIG. 8 is a schematic illustration in which the views of FIGS. 6 and 7 are superimposed, with the view of FIG. 6 shown in solid lines and with the view of FIG. 7 is shown in dashed lines.

FIGS. 6-8 illustrate another a chair 101. FIG. 6 shows the chair 101 in an upright position S101. FIG. 7 shows the chair 101 in a backwardly inclined position S102. FIG. 8 shows a superimposed view of the illustrations of FIGS. 6 and 7. The view of FIG. 6 is shown by solid lines and the view of FIG. 7 is shown by dashed lines.

The chair 101 includes a base 102, a seat shell 103 and a back shell 104. The base 102 includes a foot 105 and a carrying pillar 106. In some embodiments, the carrying pillar 106 is a height-adjustable gas-filled spring. The seat shell 103 and the back shell 104 are designed as an integrally formed supporting element 107. The seat shell 103 and the back shell 104 are connected by two lateral connecting struts 108, 109 in a manner comparable to the chair 10 shown in FIGS. 1 to 5. The connecting struts 108, 109 run on both sides of a seat surface 103*a* formed by the seat shell 103 and on both sides of a back surface 104*a* formed by the back shell 104. The back shell 104 includes an extension 110 which extends under the seat shell 103. A bore 111 is formed in the extension 110. A head 106*a* of the carrying pillar 106 is accommodated by the bore 111 (see FIG. 6). The illustrated bore 111 tapers conically from a lower side 110*b* of the extension 110.

Furthermore, the seat shell 103 and the back shell 104 are connected by a third, central connecting strut 151. The central connecting strut 151 is formed by the extension 110 of the back shell 104. The extension 110 of the back shell 104 merges integrally and in a seam-free manner in an attachment region 153 into a lower side 118 of the seat shell 3, with the formation of an intermediate space 152 lying between the extension 110 and the seat shell 103. Therefore, the seat shall 103 and the back shell 104 are connected both by means of the lateral connecting struts 108, 109 and by means of the central connecting strut 151.

As shown in the superimposed illustration of FIG. 8, the central connecting strut 151 is elastically deformed in a rear region H151 between the back surface 104*a* and the receptacle 111 when the chair 101 is in the backwardly inclined position S102 in which a person sitting on the chair 101 leans back with his/her back against the back surface 104*a* of the back shell 104.

During elastic yielding back of the back shell 104, which is made possible by elastic deformation of the central connecting strut 151 in the rear region H151 between the back surface 104*a* and the receptacle 111, the seat shell 103 is pulled toward the back shell 104 via the lateral connecting struts 108, 109. This movement, in turn, brings about an elastic deformation of a front region V151 of the central connecting strut 151, which region lies between the receptacle 111 and the attachment region 153, and therefore brings about raising of a front region V103*a* of the seat surface 103*a* and moving back of a rear region H103*a* of the seat surface 103. In this embodiment, an angle enclosed between the seat surface 103*a* and the back surface 104*a* is also increased by elastic deformation of the lateral connecting struts 108, 109. In the backwardly inclined position S102, the enclosed angle is at least 10° larger than when in the upright position S101 of the chair 101.

Figure 9:
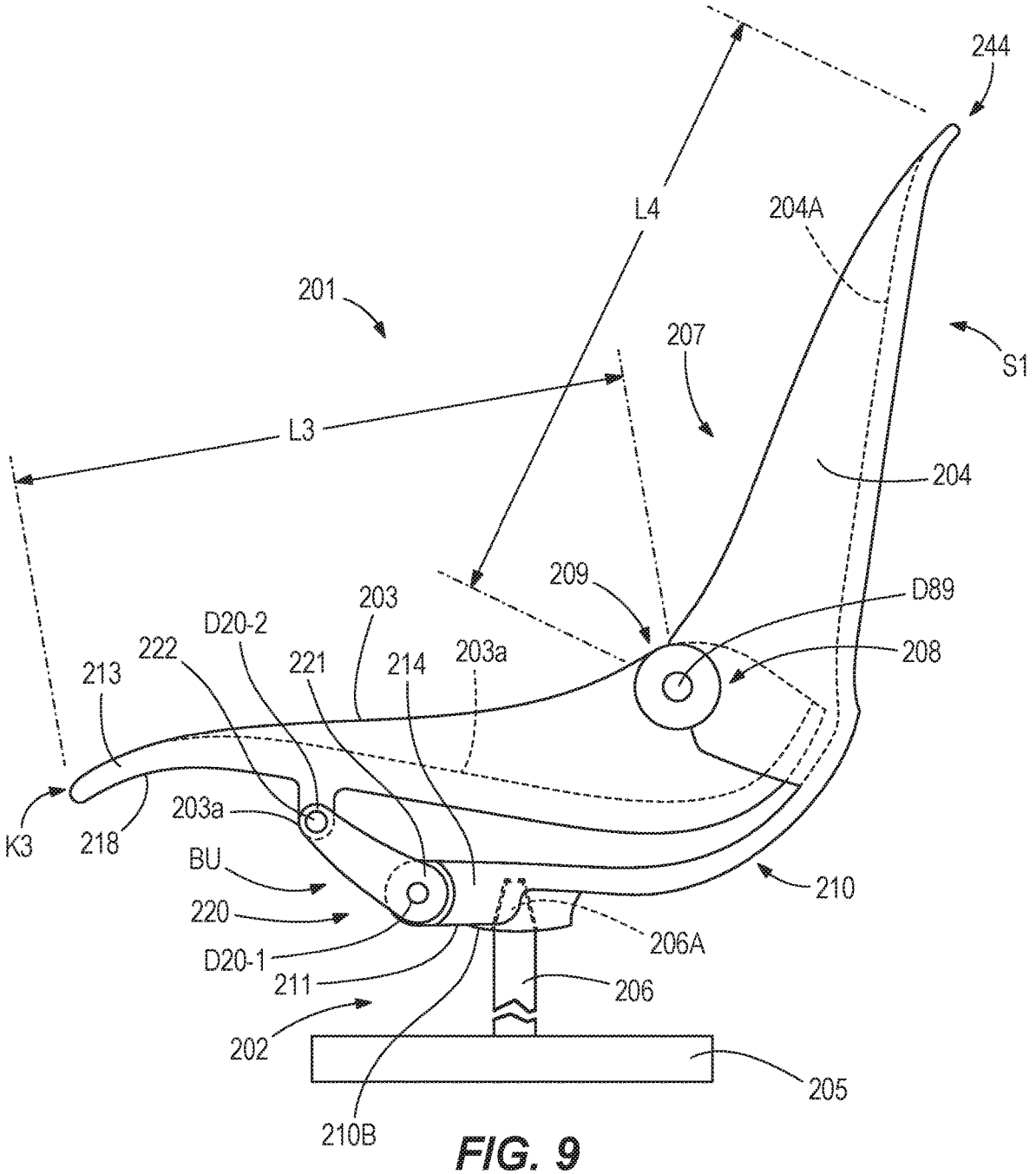
FIG. 9 is a side view of a chair according to some embodiments in an upright position.

FIG. 9 illustrates another chair 201. The chair 201 includes a base 202, a seat shell 203 and a back shell 204. The base 202 includes a foot 205 and a carrying pillar 206. The seat shell 203 and the back shell 204 together form a supporting element 207. The seat shell 203 and the back shell 204 are connected in an articulated manner to each other on both sides of a seat surface 203 and on both sides of a back surface 204*a* by means of two joints 208, 209. In the side view, the joint 209 is completely concealed by the joint 208. The back shell 204 includes an extension 210 extending to under the seat shell 203. The back shell 204 is designed in a manner formed integrally with said extension.

A bore 211 is formed on the extension 210. A head 206*a* of the carrying pillar 206 is accommodated in the bore 211. The illustrated bore tapers conically from a lower side 210*b* of the extension 210. The extension 210 of the back shell 204 is designed to be elastically deformable between the bore and the joints 208, 209. The seat shell 203 forms a first free end 213 of the supporting element 27. The extension 210 of the back shell 204 forms a second free end 214 of the supporting element 207.

The chair 201 also includes a lever arm arrangement 220. The lever arm arrangement 220 is connected about a first pivot axis D20-1 in the manner of a rotary joint to the free end 214 of the extension 10 of the back shell 204. The lever arm arrangement 220 is connected about a second pivot axis D20-2 in the manner of a rotary joint to a lower side 218 of the seat shell 203. For this purpose, the free end 214 of the extension 210 includes a bearing arrangement 221. For this purpose, the lower side 218 of the seat shell 203 includes a bearing arrangement 222.

Figure 10:
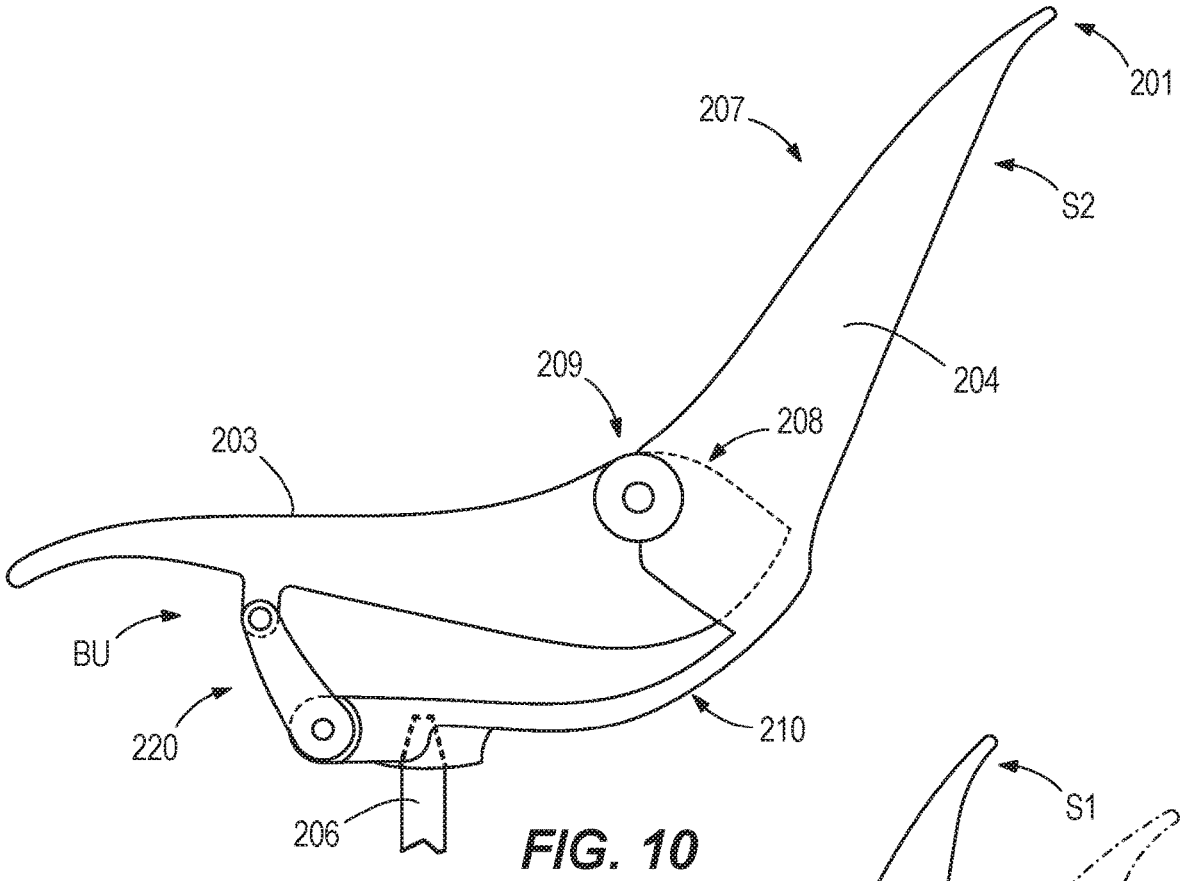
FIG. 10 is a side view of the chair shown in FIG. 9 in a backwardly inclined position.
Figure 11:
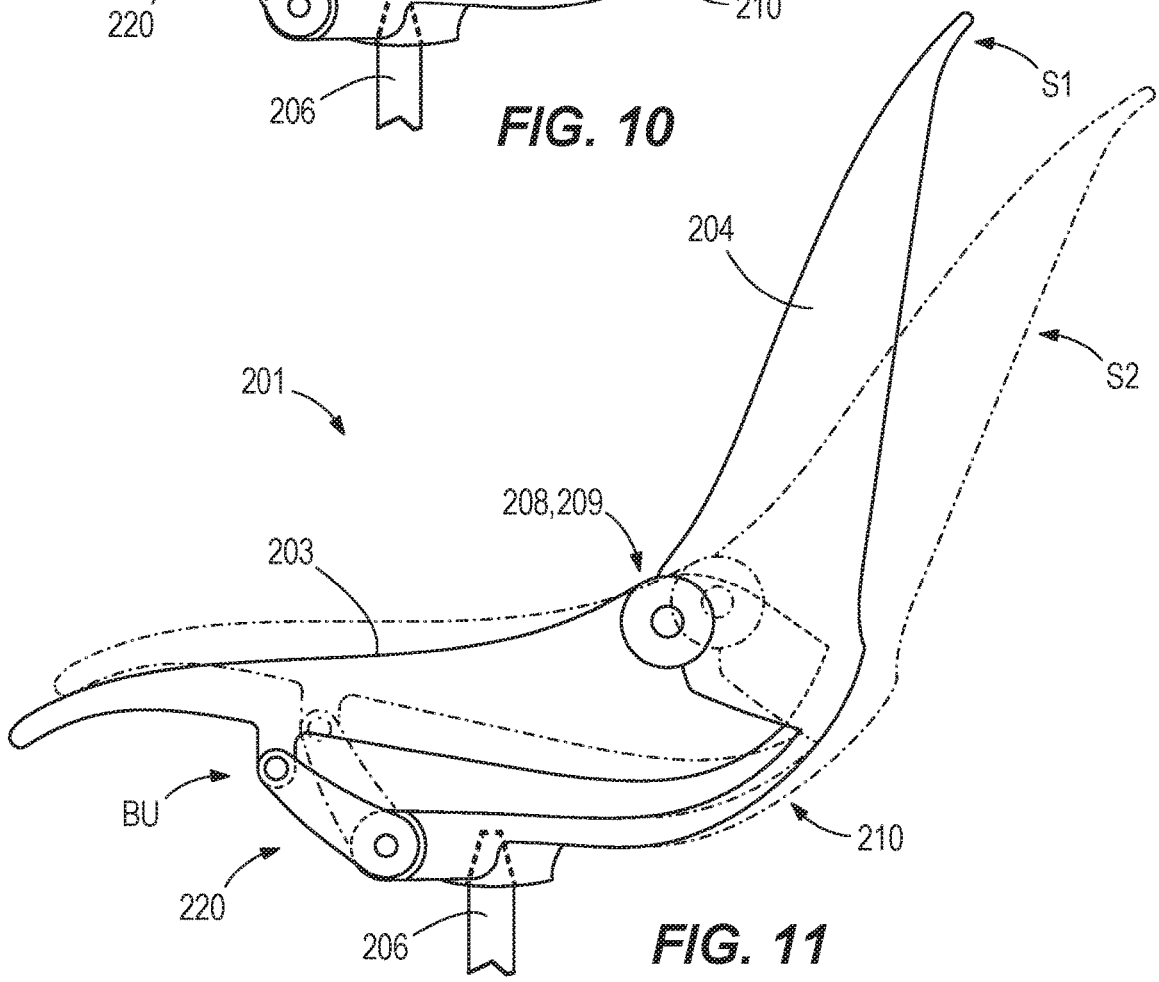
FIG. 11 is a schematic illustration in which the views of FIGS. 9 and 10 are superimposed, with the view of FIG. 9 shown in solid lines and with the view of FIG. 10 shown in dashed lines.

From a comparative examination of FIGS. 9 and 10, which show the chair 201 in an upright position S1 and in a backwardly inclined position S2, and from FIG. 11, which shows the illustrations of FIGS. 9 and 10 in superimposed form, the lever arrangement 220 guides the seat element 203 on a circular path such that the seat element 203 is raised in the backwardly inclined position S2 of the chair 201.

The seat shell 203 and the back shell 204 overlap in the region of the joints 208, 209. The seat shell 203 is guided in the back shell 204 such that an angle which a seat surface 203*a* of the seat shell 203 encloses with a back surface 204*a* of the back shell 204 can increase between the upright position S1 of the chair 201 and the backwardly inclined position S2 of the chair 1 without the seat shell 203 and the back shell 204 colliding with each other. In fact, the back shell 204 can be pivoted past the seat shell 203 in a manner rotatable about a third axis of rotation D89 defined by the joints 208 and 209.

Therefore, the seat shell 203 and the back shell 204 overlap to a greater degree in the backwardly inclined position S2 of the chair 201 than in the upright position S1 of the chair 201.

Furthermore, the seat shell 203 and the back shell 204 are formed symmetrically with the effect that a seat shell length L3, which is measured between the axis of rotation D89 running through the two joints and a front edge K3 of the seat shell 203, is between 90% and 110% of a back shell length L4, which is measured between the axis of rotation D89 running through the two joints and an upper edge K4 of the back shell 204.

The joints 208, 209 which connect the seat shell 203 and the back shell 204 serve as tensile force transmission means during a movement of the chair 201 from the upright position S1 into a backwardly inclined position S2 and pull the seat shell 203, which is coupled to the lever arrangement 220, upwards and in the direction of the back shell 204. During a movement of the chair 201 from the backwardly inclined position S2 into the upright position S1, the joints 208, 209 serve as compressive force transmission means and push the seat shell 203, which is coupled to the lever arrangement 220, downwards and away from the back shell 204.

The movement of the back shell 204 under loading by a person sitting on the chair and inclined rearwards against the back surface 204*a* of the back shell 204 is made possible by the fact that the back shell 204 is deformed during the inclination backwards and, in the backwardly inclined position S2 of the chair 201, is elastically deformed in such a manner that a counter-force is generated, by means of which the back shell 204 and the seat shell 203 connected to the latter move into the upright position S1 of the chair 201 when the person sitting on the chair reduces their force applied against the back surface. In the backwardly inclined position S2 of the chair 201, the back shell 204 is elastically deformed primarily in a region of the extension 210 that adjoins a back surface 204*a* of the back shell 204.

The lever arrangement 220 forms a movement converter BU by means of which a spatial orientation of the seat shell 203 is mechanically controlled depending on an inclination of the back shell 204.

Figure 12:
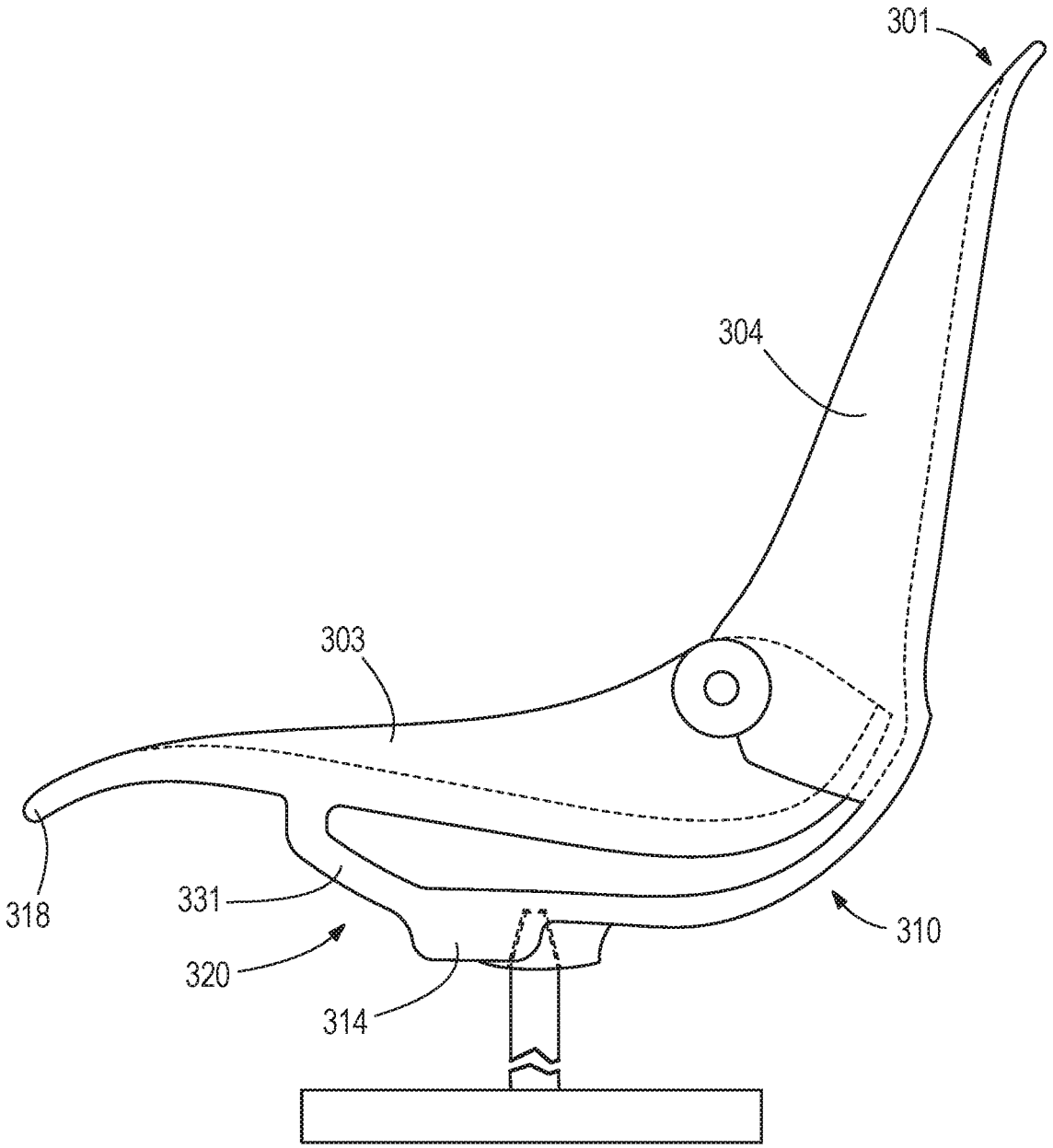
FIG. 12 is a side view of a chair according to some embodiments in an upright position.

FIG. 12 shows another chair 301. Reference is made to the description of the chair 201 shown in FIGS. 9-11 for description of the general components and operation of the chair 301. In contrast to the chair 201, the illustrated chair 301 includes a lever arrangement 320 which is free from a rotary joint and has an elastically deformable lever 331. The elastically deformable lever 331 is connected to a free end 314 of an extension 310 of a back shell 304 and to a lower side 318 of a seat shell 303. The lever arrangement 320 is formed elastically in such a manner that the seat shell 303, guided by the lever arrangement 320 and with elastic deformation of the lever 331 relative to the extension 310 of the back shell, is movable in two directions in space.

In other embodiments of the chairs 201, 301, the joints may be elastically extendable and bendable zones which permit movement of the seat shell and the back shell with respect to each other. This movement may be approximate to a pivoting movement.

FIGS. 13-21 illustrate a chair 401 according to another embodiment. The chair 401 includes a base 402, a seat shell 403, and a back shell 404. The base 402 is coupled to a receptacle 411 at an upper end 402*a* of the base 402. The seat shell 403 is supported by the receptacle 411. The seat shell 403 forms a seat surface 403*a*. The back shell 404 forms a back surface 404*a*. The seat surface 403*a* and the back surface 404*a* are configured to be engaged by a user sitting in the chair 401. The seat shell 403 is connected to the back shell 404 on both sides of the seat surface 403*a* and on both sides of the back surface 404*a*. The back shell 404 includes an extension 410 extending from the back surface 404*a* to the receptacle 411. The extension 410 is elastically deformable. The seat shell 403 forms a bottom surface 403*b*. The bottom surface 403*b* is opposite the seat surface 403*a*. The chair 401 also includes a tilt housing 416 secured to the bottom surface 403*b*. The tilt housing 416 is movably coupled to the receptacle 411. The tilt housing 416 is secured to the bottom surface 403*b* of the seat shell 403.

Figure 14:
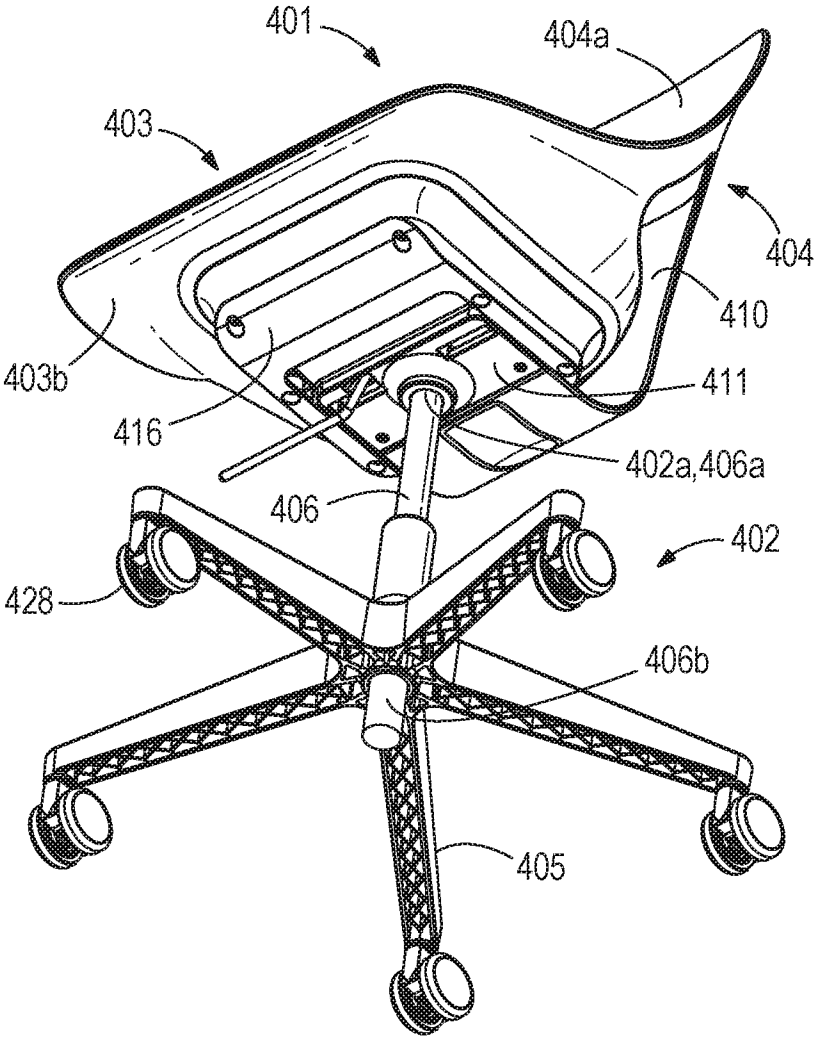
FIG. 14 is a bottom perspective view of the chair shown in FIG. 13.
Figure 13:
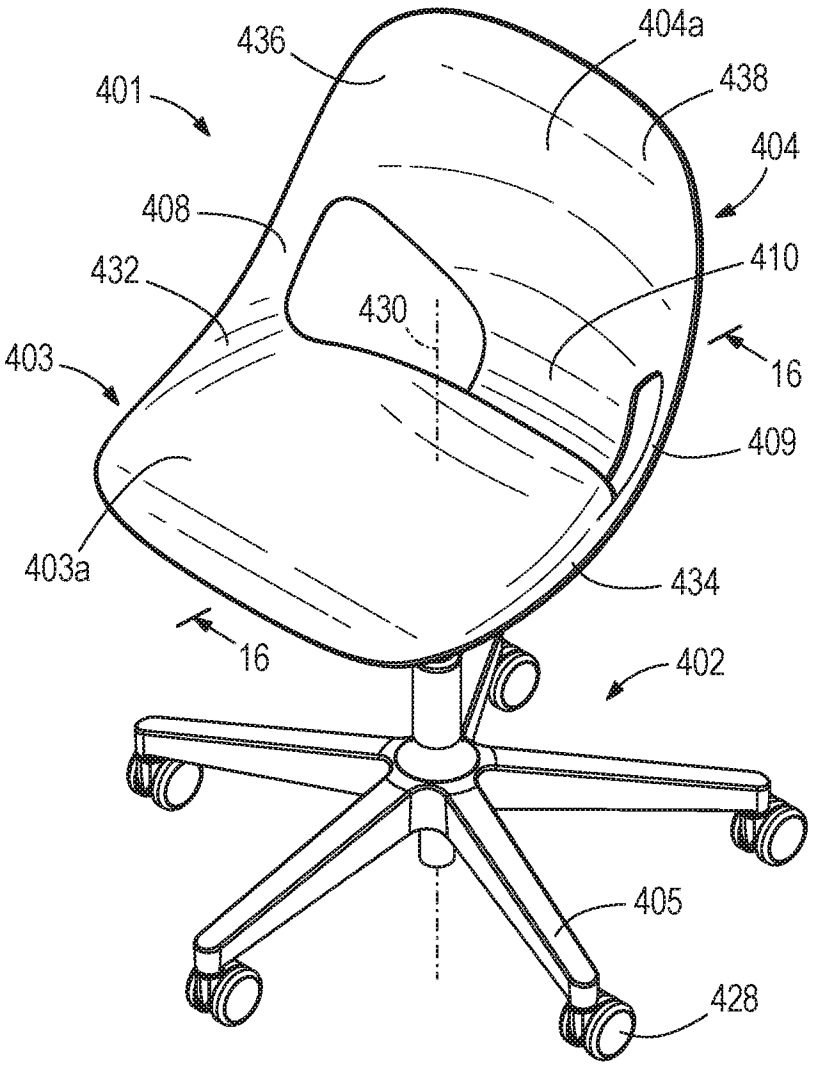
FIG. 13 is a top perspective view of a chair according to some embodiments.
Figure 23:
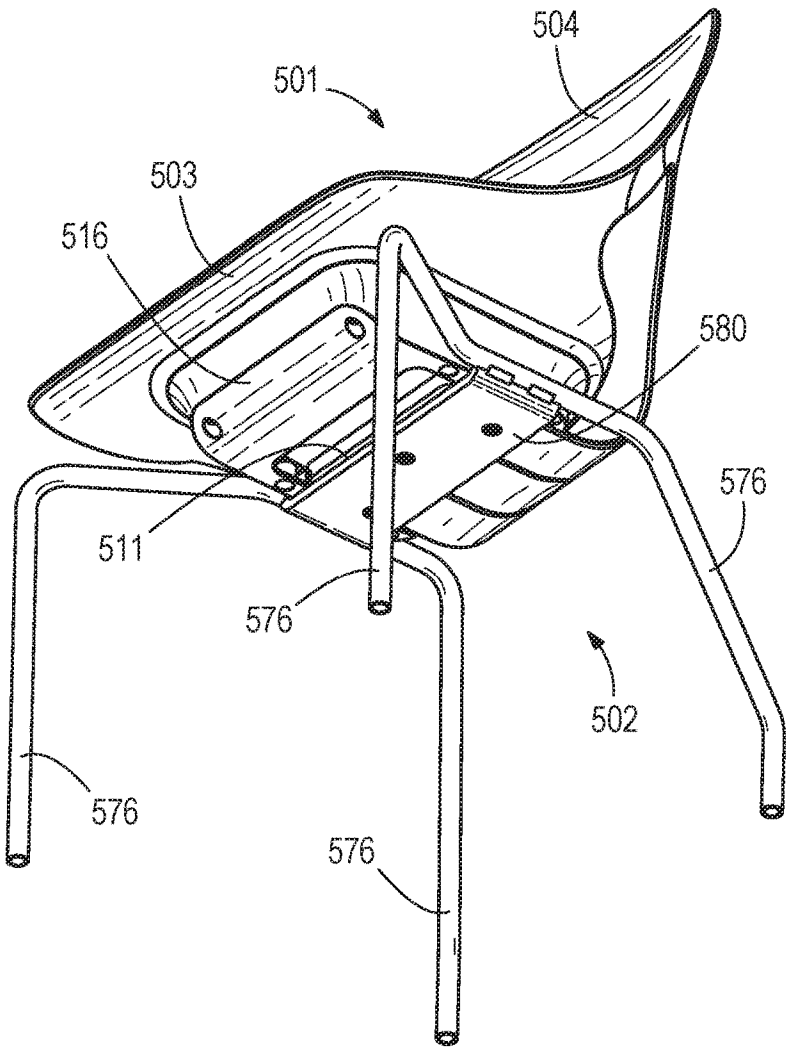
FIG. 23 is a bottom perspective view of the chair shown in FIG. 22.
Figure 22:
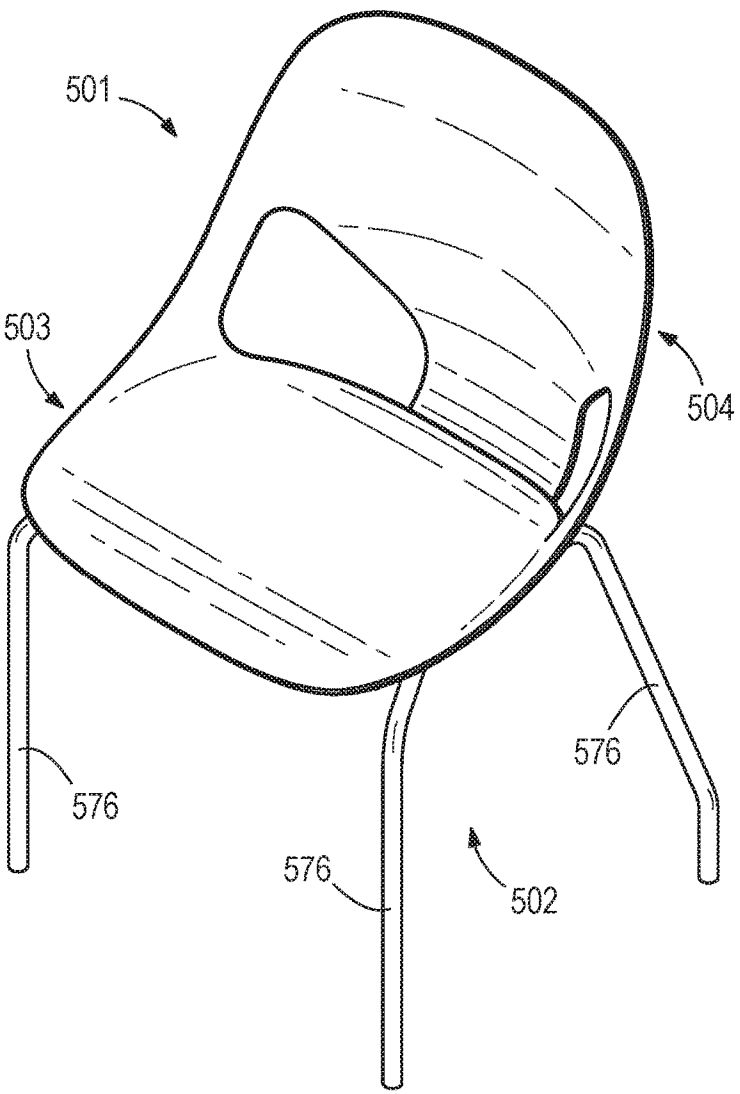
FIG. 22 is a top perspective view of a chair according to some embodiments.

As illustrated in FIGS. 13-14, the base 402 includes a carrying pillar 406 and a plurality of feet 405. The carrying pillar 406 has an upper end 406*a* and a lower end 406*b*. The upper end 406*a* of the carrying pillar 406 is coupled to the receptacle 411. The lower end 406*b* of the carrying pillar 406 is coupled to the plurality of feet 405. The carrying pillar 406 also includes telescoping segments. The telescoping segments are adjustable (e.g., by a gas spring) to change a height of the seat shell 403. The plurality of feet 405 extend radially outward from the lower end 406*b* of the carrying pillar 406. In the illustrated embodiment, a caster 428 is coupled to each of the feet 405. In other embodiments, the casters 428 may be omitted. The base 402 defines a vertical axis 430. The illustrated vertical axis 430 is a central longitudinal axis of the carrying pillar 406 extending along a height of the base 402. In the illustrated embodiment, the carrying pillar 406 extends from the feet 405 along the vertical axis 430. In other embodiments, the base 402 may have other configurations (e.g., spaced apart, fixed legs as shown in FIGS. 22-23, a stool-height base, etc.), but may still have the vertical axis 430.

In the illustrated embodiment, the seat shell 403 and the back shell 404 are integrally formed as a single piece. In some embodiments, the seat shell 403 and the back shell 404 may be integrally formed from plastic. The plastic is elastically deformable. The seat shell 403 is connected to the back shell 404 by a first connecting lateral strut 408 and a second connecting lateral strut 409. The first connecting lateral strut 408 is spaced apart from the extension 410. The first lateral connecting strut 408 connects a first side 432 of the seat shell 403 to a first side 436 of the back shell 404. The second lateral connecting strut 409 is spaced apart from the extension 410. The second lateral connecting strut 409 connects a second side 434 of the seat shell 403 to a second side 438 of the back shell 404. The first side 432 of the seat shell is opposite the second side 434 of the seat shell 403. The first side 436 of the back shell is opposite the second side 438 of the back shell 404. The first lateral connecting strut 408 and the second lateral connecting strut 409 connect the seat shell 403 to the back shell 404 on both sides of the seat surface 403*a* and the back surface 404*a*. The first lateral connecting strut 408, the second lateral connecting strut 409, the seat shell 403 and the back shell 404 are integrally formed as a single piece.

Figure 15:
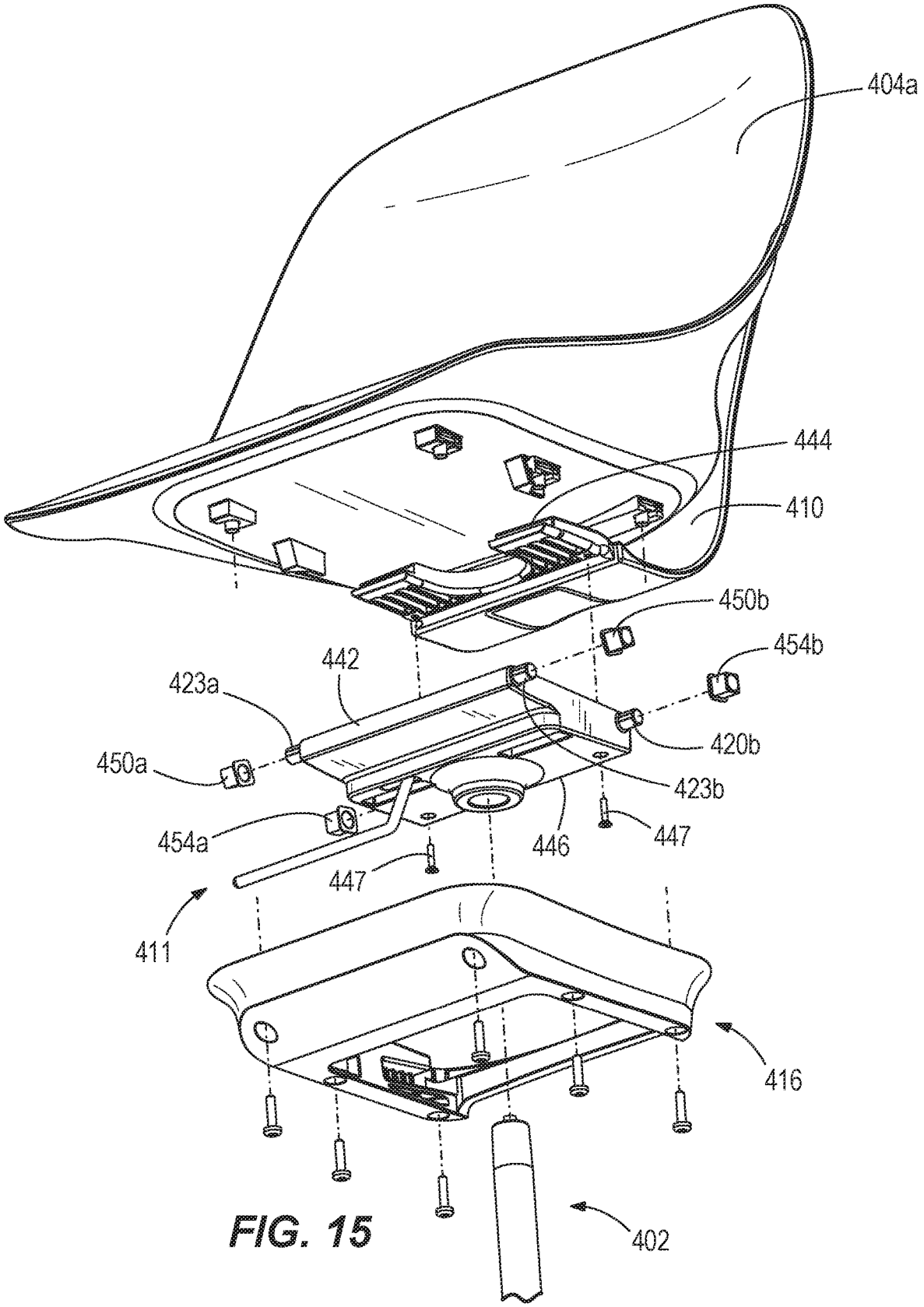
FIG. 15 is an exploded perspective view of a portion of the chair shown in FIG. 13.

The back surface 404*a* is integrally formed as a single piece with the extension 410. The extension 410 extends from under the seat shell 403 to the back surface 404*a* of the back shell 404. The extension 410 is a spring element. The extension 410 is elastically deformable between the receptacle 411 and the back surface 404*a*. As shown in FIG. 15, the receptacle 411 defines a forward end 442 and a rearward end 446 opposite the forward end 442. The rearward end 446 faces towards the back surface 404*a* of the back shell 404. The extension 410 includes a distal end 444 coupled to the back end 446 of the receptacle 411. The distal end 444 is opposite from the back surface 404*a*. In the illustrated embodiment, the extension 410 is coupled to the receptacle 411 via one or more fasteners 447 (e.g., bolts, screws, etc.). In other embodiments, the extension 410 may be integrally formed with the receptacle 411, or may be permanently secured to the receptacle by adhesives and/or welding. The connection between the extension 410 and the receptacle 411 is under the seat shell 403.

Figure 18:
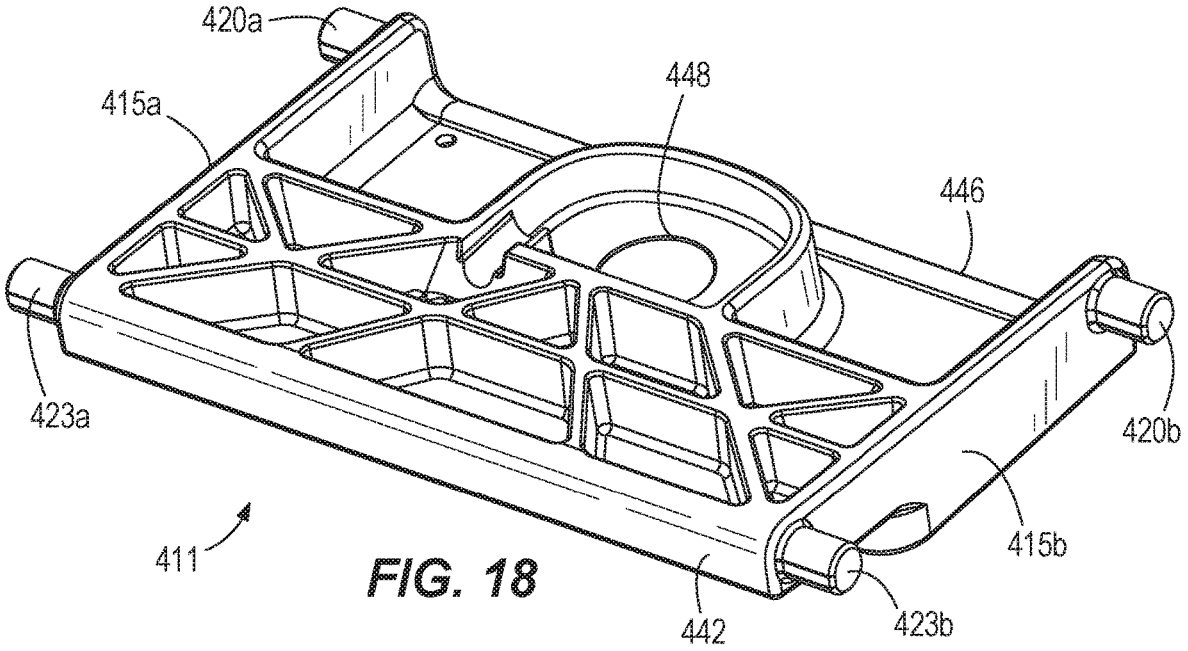
FIG. 18 is a top perspective view of a receptacle of the chair shown in FIG. 13.
Figure 19:
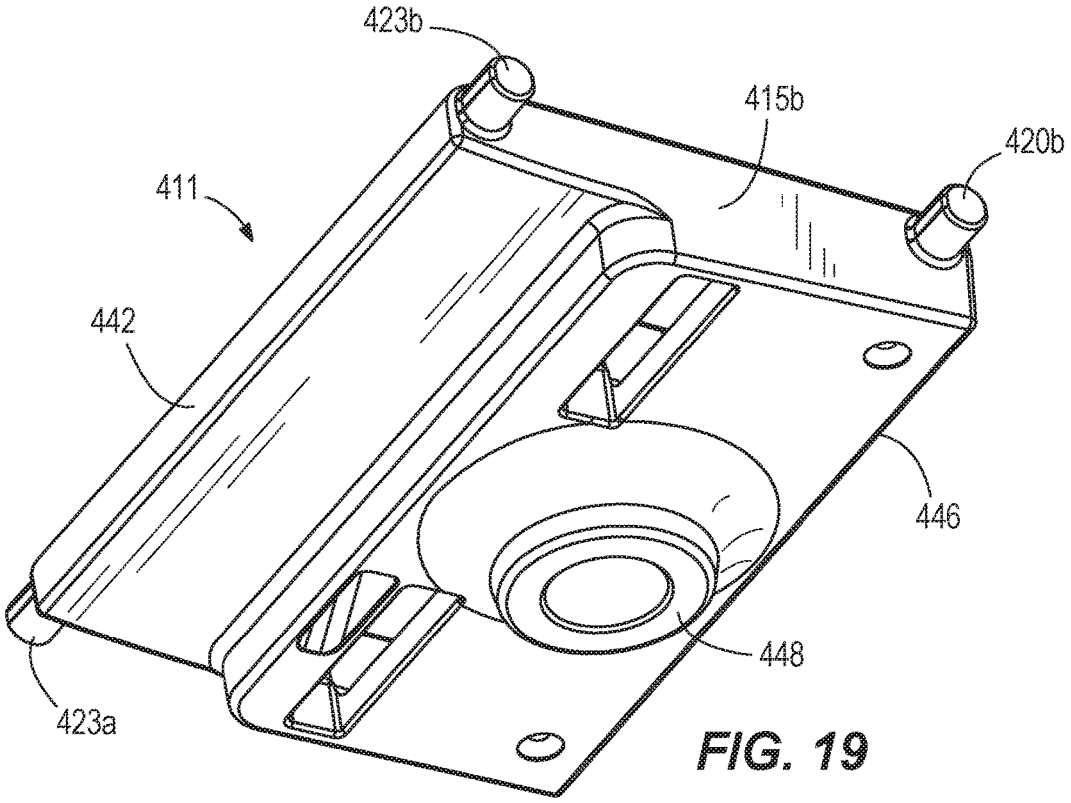
FIG. 19 is a bottom perspective view of the receptacle shown in FIG. 18.

As shown in FIGS. 18-19, the receptacle 411 includes an opening 448 that receives the carrying pillar 406. The receptacle 411 includes a first side 415*a* and a second side 415*b*. The first side 415*a* and the second side 415*b* extend from the forward end 442 of the receptacle to the rearward end 446. The first side 415*a* is opposite the second side 415*b*. The receptacle 411 also includes a first pin 423*a* and a second pin 420*a*. The first pin 423*a* and the second pin 420*a* are located on the first side 415*a* of the receptacle 411. The first pin 423*a* and the second pin 420*a* extend from the first side 415*a* of the receptacle 411. The first pin 423*a* is positioned adjacent the forward end 442 of the receptacle 411. The second pin 420*a* is positioned adjacent the rearward end 446 of the receptacle 411. The receptacle 411 also includes a third pin 423*b* and a fourth pin 420*b*. The third pin 423*b* and the fourth pin 420*b* are located on the second side 415*b* of the receptacle 411. The third pin 423*b* and the fourth pin 420*b* extend from the second side 415*b* of the receptacle 411. The third pin 423*b* is positioned adjacent the forward end 442 of the receptacle 411. The third pin 423*b* is in line with the first pin 423*a*. The fourth pin 420*b* is positioned adjacent the rearward end 446 of the receptacle 411. The fourth pin 420*b* is in line with the second pin 420*b*.

As illustrated, a first bearing 450*a* is coupled to the first pin 423*a*. The first bearing 450*a* is adjacent a free end of the first pin 423*a*. A second bearing 454*a* is coupled to the second pin 420*a*. The second bearing 454*a* is adjacent a free end of the second pin 420*a*. Each of the first bearing 450*a* and the second bearing 454*a* has a square cross-sectional shape. A third bearing 450*b* is coupled to the third pin 423*b*. The third bearing 450*b* is adjacent a free end of the third pin 423*b*. A fourth bearing 454*b* is coupled to the fourth pin 420*b*. The fourth bearing 454*b* is adjacent a free end of the fourth pin 420*b*. Each of the third bearing 450*b* and the fourth bearing 454*b* also has a square cross-sectional shape. In other embodiments, the chair 410 may include other suitable bearings, or the bearings may be omitted.

Figure 20:
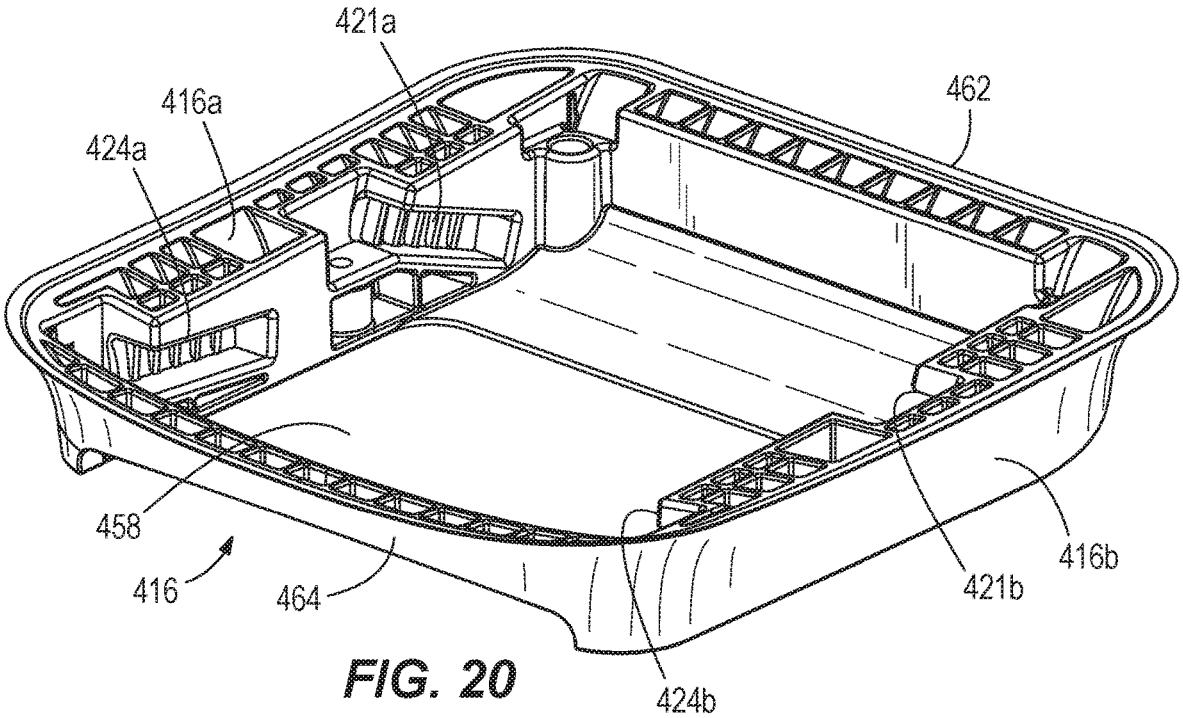
FIG. 20 is a top perspective view of a tilt housing of the chair shown in FIG. 13.
Figure 21:
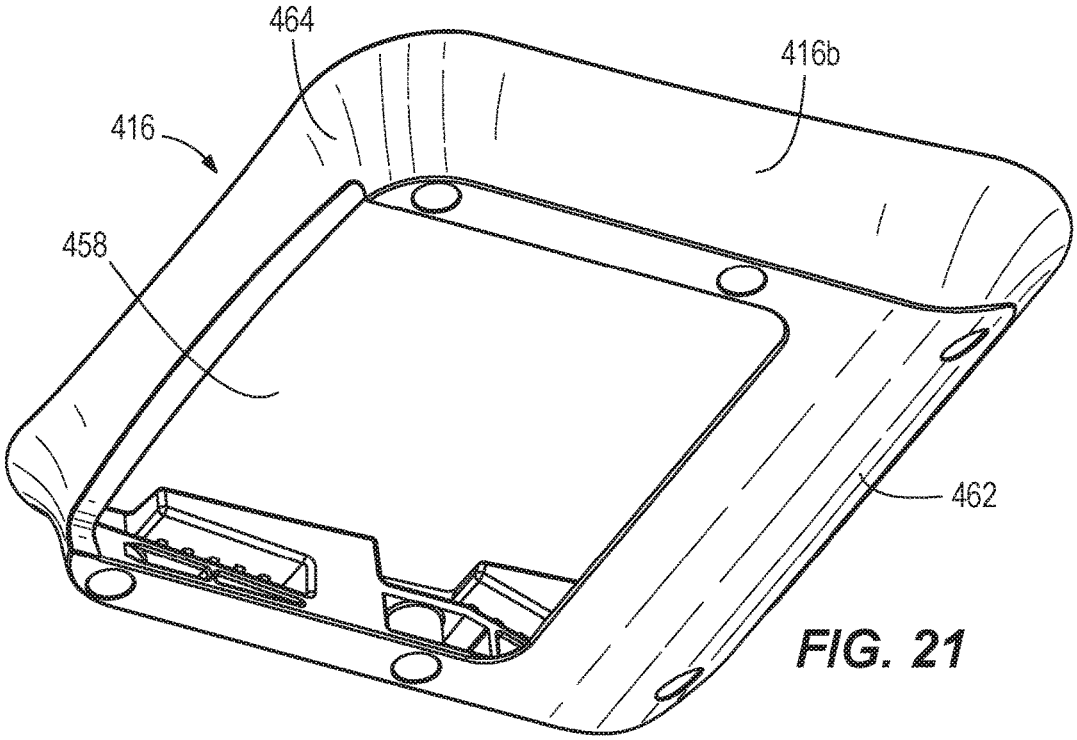
FIG. 21 is a bottom perspective view of the tilt housing shown in FIG. 20.

As shown in FIGS. 20-21, the tilt housing 416 includes an opening 458 that receives the receptacle 411. The tilt housing 416 includes a first side 416*a* and a second side 416*b*. The first side 416*a* and the second side 416*b* extend from a forward end 462 of the tilt housing to a rearward end 464. The first side 416*a* is opposite the second side 416*b*. The illustrated tilt housing 416 defines a first track 424*a* that receives the first pin 423*a* and a second track 421*a* that receives the second pin 420*a*. The first track 424*a* and the second track 421*a* are on the first side 416*a* of the tilt housing 416. The first track 424*a* is adjacent the forward end 458 of the tilt housing 416. The second track 421*a* is adjacent the rearward end 464 of the tilt housing 416. The tilt housing 416 also defines a third track 424*b* that receives the third pin 423*b* and a fourth track 421*b* that receives the fourth pin 420*b*. The third track 424*b* and the fourth track 421*b* are on the second side 416*b* of the tilt housing 416. The third track 424*b* is adjacent the forward end 458 of the tilt housing 416. The fourth track 421*b* is adjacent the rearward end 464 of the tilt housing 416. The first bearing 450*a* is positioned within the first track 424*a*. The second bearing 454*a* is positioned within the second track 421*a*. The third bearing 450*b* is positioned within the third track 424*b*. The fourth bearing 454*a* is positioned within the fourth track 421*b*.

In other embodiments, the relative positions of the pins 423*a*, 423*b*, 420*a*, 420*b* and the tracks 424*a*, 424*b*, 421*a*, 421*b* may be reversed. For example, the pins may be coupled to and extend from the tilt housing 416, while the tracks may be formed in the receptacle 411.

Figure 16:
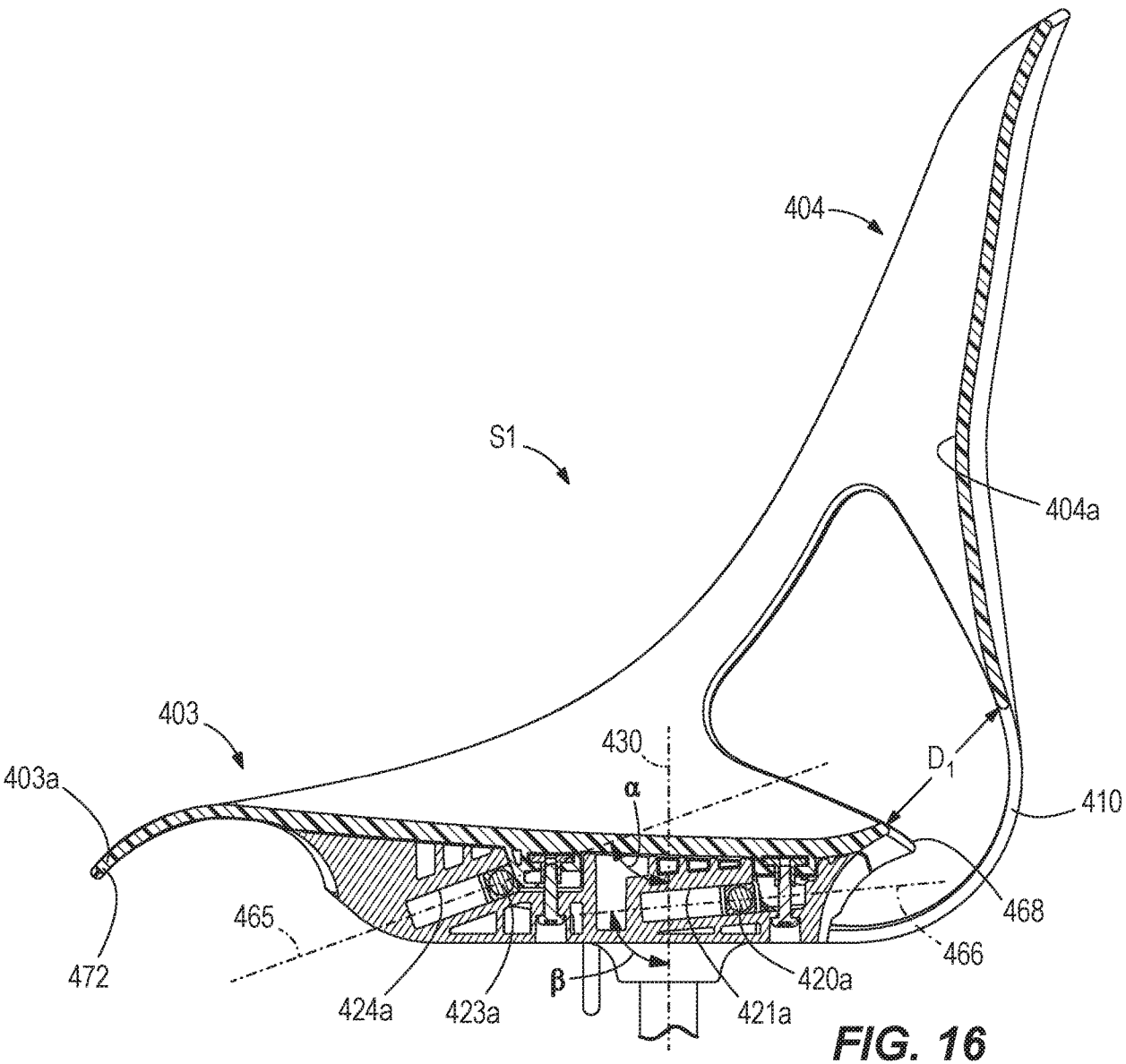
FIG. 16 is a cross-sectional view of the chair taken along section line 16-16 of FIG. 13 while in an upright position.

As shown in FIG. 16, the first track 424*a* extends along a first longitudinal axis 465 that is oriented at a first angle $\alpha$ relative to the vertical axis 430. The second track 421*a* extends along a second longitudinal axis 466 that is oriented at a second angle $\beta$ relative to the vertical axis 430. Similar to the first track 424*a*, the third track 424*b* extends along a third longitudinal axis that is oriented at the first angle relative $\alpha$ to the vertical axis 430. Similar to the second track 421*a*, the fourth track 421*b* extends along a fourth longitudinal axis that is oriented at the second angle $\beta$ relative to the vertical axis 430. The second angle $\beta$ is different from the first angle $\alpha$. More particularly, the first angle $\alpha$ is smaller than the second angle (3. In some embodiments, the first angle $\alpha$ is between about 60° and 80°, and the second angle $\beta$ is between about 70° and 90°. In other embodiments, the first angle $\alpha$ may be about 70° and the second angle $\beta$ may be about 85°.

Figure 17:
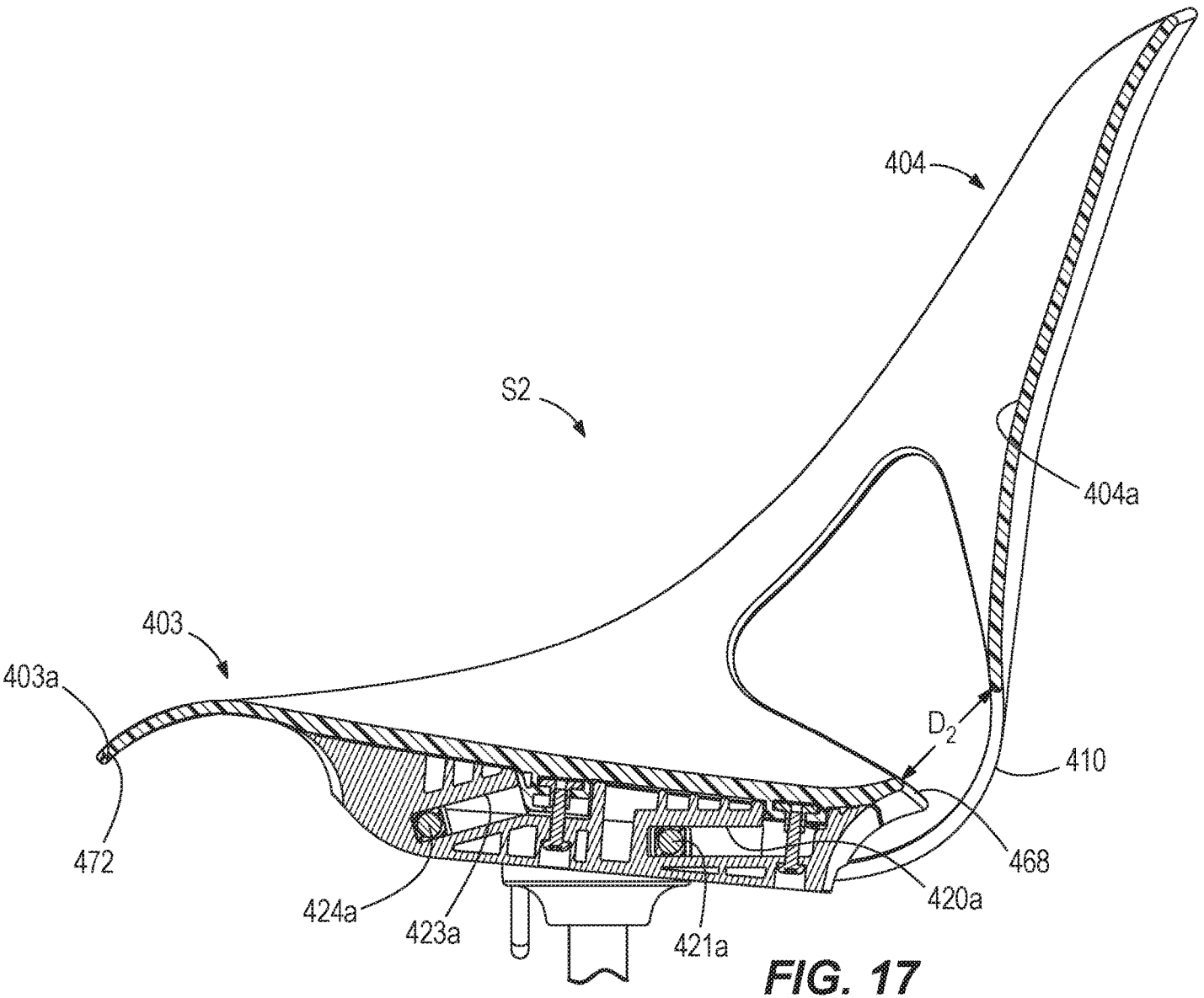
FIG. 17 is a cross-sectional view of the chair taken along section line 16-16 of FIG. 13 while in a backwardly inclined position.

As shown in FIGS. 16-17, the chair 401 is movable from an upright position S1 to a backwardly inclined position S2 when a force is applied to the back shell 404. In the upright position S1, a rear edge 468 of the seat shell 403 is spaced a first distance $D_1$ from the back surface 404*a* of the back shell 404. In the backwardly inclined position S2, the rear edge 468 of the seat shell 403 is spaced a second distance $D_2$ from the back surface 404*a* of the back shell 404. The first distance $D_1$ is greater than the second distance $D_2$. The first distance $D_1$ is greater than or equal to a length of the second track 421*a*. In the upright position S1, a front edge 472 of the seat shell 403 moves upward towards the back shell 404. The seat shell 403 and the back shell 404 define a first angle in the upright position S1 and a second angle in the backwardly inclined position S2. The second angle is greater than the first angle. Specifically, the second angle is greater than the first angle by more than 10°.

The first pin 423*a* is slidable in the first track 424*a* and the second pin 420*a* is slidable in the second track 421*a* when the force is applied to the back shell 404. Each track defines a forward end and a rearward end. In the upright position S1 (FIG. 16), the first pin 423*a* is adjacent the rearward end of the first track 424*a* and the second pin 420*a* is adjacent the rearward end of the second track 421*a*. When a force is applied to the back shell 404, the first pin 423*a* moves towards the forward end of the first track 424*a* and the second pin 420*a* moves toward the forward end of the second track 421*a*. In the backwardly inclined position S2 (FIG. 17), the first pin 423*a* is adjacent the forward end of the first track 424*a* and the second pin 420*a* is adjacent the forward end of the second track 421*a*. The third pin 423*b* moves in the same manner in the third track 424*b* as the first pin 423*a* in the first track 424*a*. The fourth pin 420*b* moves in the same manner in the fourth track 421*b* as the second pin 420*a* in the second track 421*a*. The seat surface 403*a* rises as the first pin 423*a* slides in the first track 424*a* and the second pin slides 420*a* in the second track 421*a*. When the chair 401 is in the backwardly inclined position S2, the seat surface 403*a* is at an uppermost position, and when the chair 401 is in the upright position S1, the seat surface 403*a* is at a lowermost position. Potential energy stored from raising the seat surface 403*a* (and, thereby, a user seated on the seat surface 403*a*) is used to supplement the return energy stored in the flexible extension 410.

When the chair 401 is in the backwardly inclined position S2, the extension 410 is elastically deformed in such a manner that the extension 410 generates a first counter force to return the chair 401 to the upright position S1. In the upright position S1, the extension 410 is in an undeformed position. In the backwardly inclined position S2, the extension 410 is in a deformed position. The extension 410 is biased to move the chair 401 into the upright position S1. The seat surface 403*a* rises when the chair 401 is moved from the upright position S1 to the backwardly inclined position S2. A weight of the user of the chair 401 generates a second counter force to return the chair 401 to the upright position S1. In some embodiments, the first counter force may be considered a fixed response force that remains constant regardless of the user seated in the chair 410. In other words, the first counter force from the extension 410 is the same for different sizes (e.g., weights) of users. In some embodiments, the second counter force may be considered a variable response force that is different depending on the user. For example, heavier users may generate a larger second counter force than lighter users.

FIGS. 22-23 illustrate a chair 501 according to another embodiment. The chair 501 includes a base 502, a seat shell 503, a back shell 504, a receptacle 511, and a tilt housing 516, similar to the chair 401 described above. In the illustrated embodiment, however, the base 502 includes a plurality of legs 576. The illustrated legs 576 are spaced apart at corners of the seat shell 503. The legs 576 are connected together by a connecting portion 580. The connecting portion 580 is fastened to receptacle 511 via a plurality of fasteners.

FIGS. 24-28 illustrate a chair 601 according to yet another embodiment. The chair 601 includes base 602, a seat shell 603, and a back shell 604. The base 602 is coupled to a receptacle 611 at an upper end of the base 602. The seat shell 603 is supported by the receptacle 611. The seat shell 603 forms a seat surface 603*a*. The back shell 604 forms a back surface 604*a*. The seat shell 603 is connected to the back shell 604 on both sides of the seat surface 603*a* and on both sides of the back surface 604*a*. The back shell 604 includes an extension 610 extending from the back surface 604*a* to the receptacle 611. The extension 610 is elastically deformable. The seat shell 603 forms a bottom surface 603*b*. The bottom surface 603*b* is secured to a tilt housing 616. The tilt housing 616 is secured to the receptacle 611.

Figure 25:
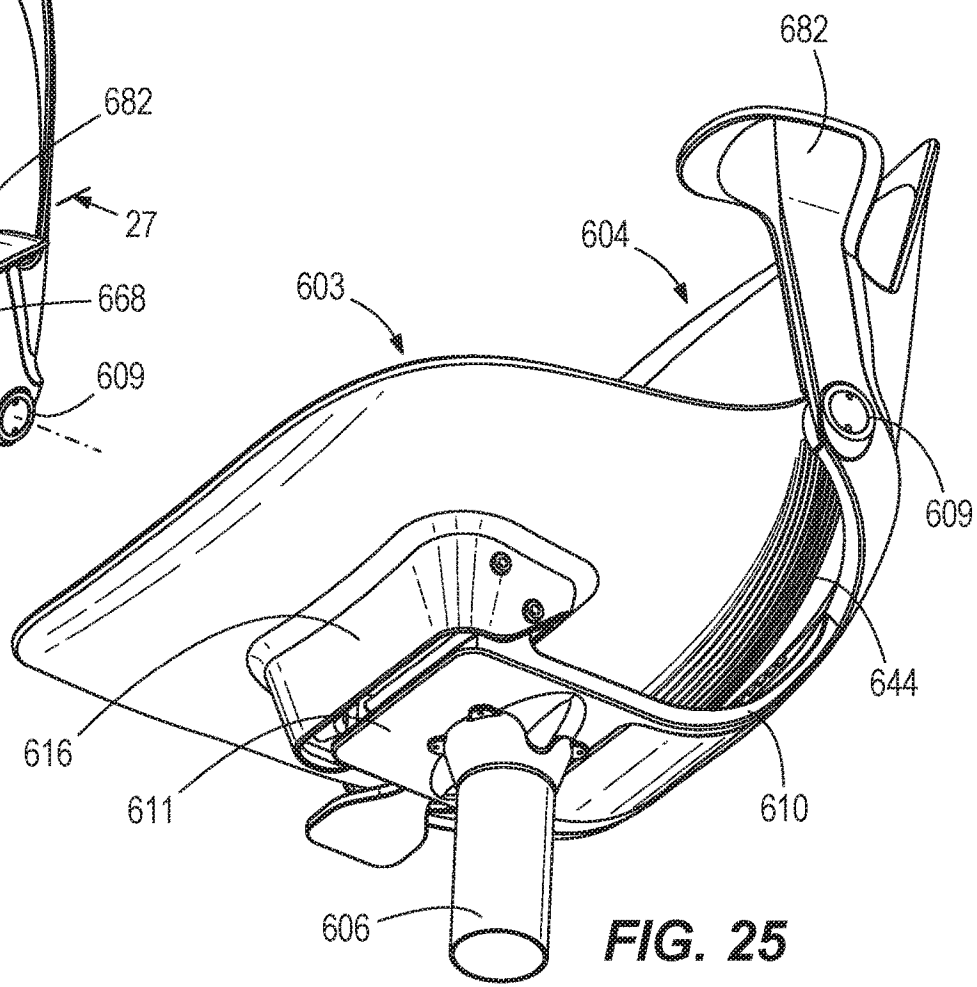
FIG. 25 is a bottom perspective view of the chair shown in FIG. 24.
Figure 24:
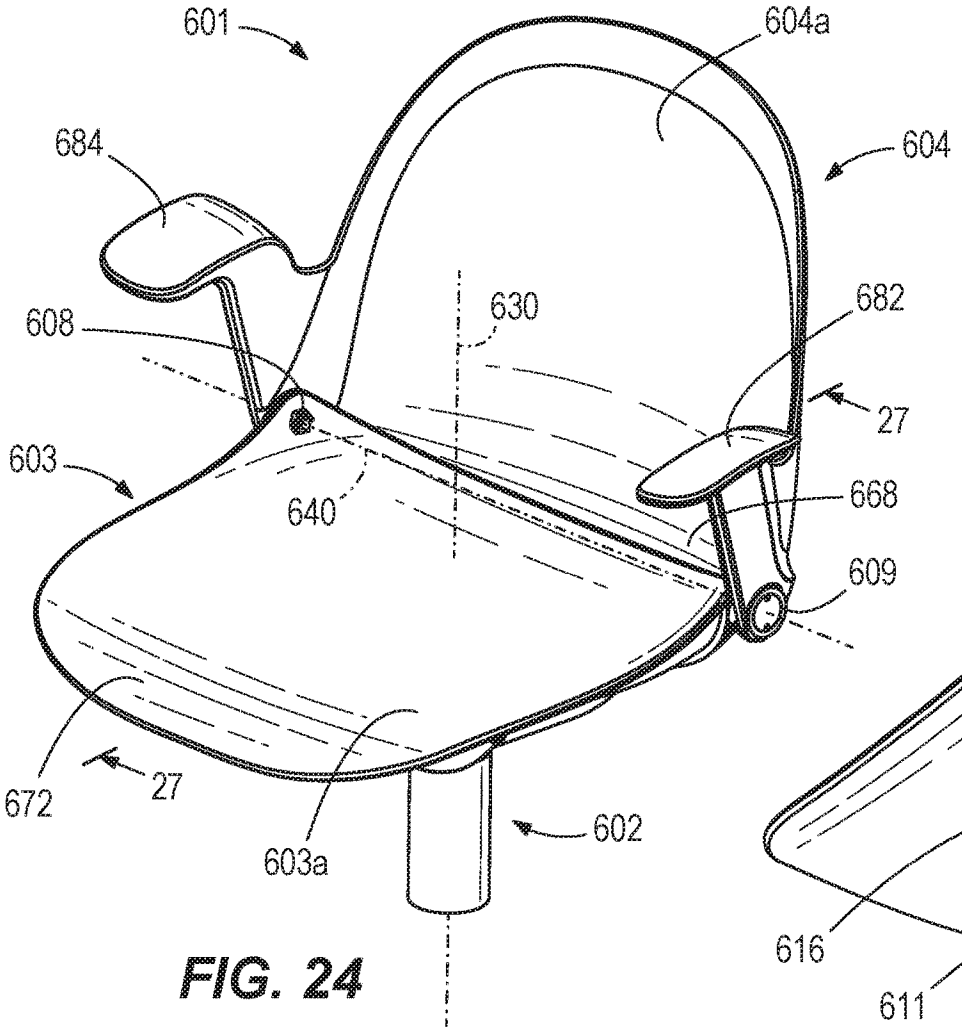
FIG. 24 is a top perspective view of a chair according to some embodiments.
Figure 26:
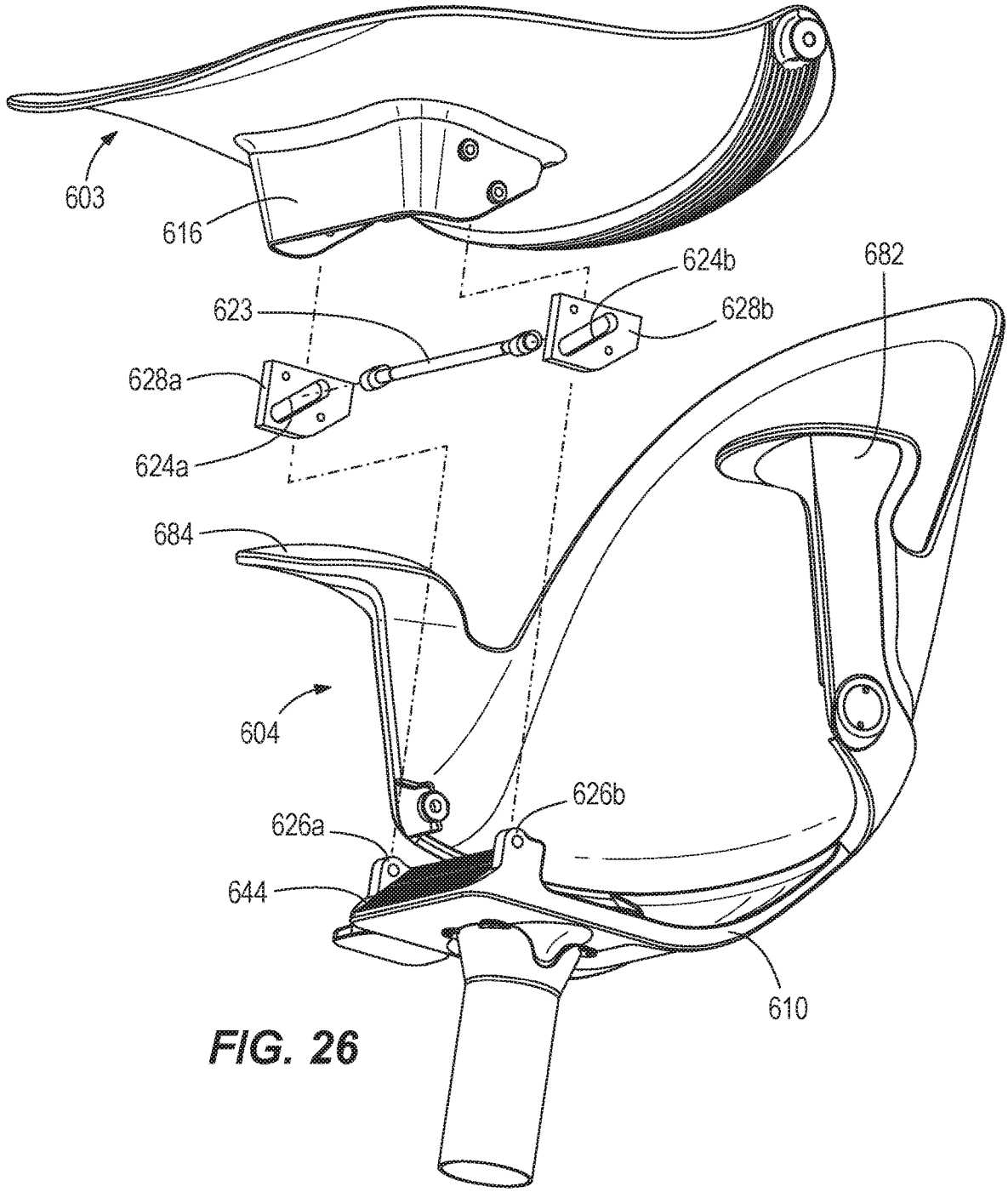
FIG. 26 is an exploded perspective view of the chair shown in FIG. 24.

As illustrated in FIGS. 24-26, the base 602 includes at least a carrying pillar 606. An upper end of a carrying pillar 606 is coupled to the receptacle 611. The base 602 also defines a vertical axis 630. The illustrated vertical axis 630 is a central longitudinal axis of the carrying pillar 606 extending along a height of the base 602.

In the illustrated embodiment, the seat shell 603 and the back shell 604 are formed as separate pieces. The seat shell 603 and the back shell 604 may be formed from plastic. The plastic is elastically deformable. The seat shell 603 is connected to the back shell 604 in an articulated manner. The seat shell 603 is connected to the back shell 604 on both sides of the seat surface 603*a* and on both sides of the back surface 604*a* by two joints 608, 609. The back shell 604 is pivotably coupled to the seat shell 603 via the two joints 608, 609. The two joints 608, 609 form a pivot axis 640. The back shell 604 is pivotable relative to the seat shell 603 about the pivot axis 640. The pivot axis 640 is perpendicular to the vertical axis 630 of the base 602

The seat shell 603 includes a forward end 672 and a rearward end 668. The rearward end 668 is coupled to the back shell 604 via the two joints 608, 609. The rearward end 668 includes a plurality of ribs 644. The plurality of ribs 644 extend between both sides of the seat shell 603.

The back shell 604 includes a first arm rest 682 and a second arm rest 684 extending from the two joints 608, 609. The arm rests 682, 684 may be integrally formed with the back shell 604 or may be separate parts that are coupled to the back shell 604. The arm rests 682, 684 may be adjustable (e.g., vertically adjustable and/or horizontally adjustable) or may be stationary.

The extension 610 extends from the back surface 604*a* to under the seat shell 603. A distal end 644 of the extension 610 is coupled to the receptacle 611. In the illustrated embodiment, the receptacle 611 is integrally formed as a single piece with the extension 610. In other embodiments, the receptacle 611 may be a separate piece from the extension 610. The extension 610 is elastically deformable between the receptacle 611 and the two joints 608, 609.

The receptacle 611 is secured to the tilt housing 616. As shown in FIG. 26, the illustrated receptacle 611 is secured to the tilt housing using a pin 623 and tracks 624*a*, 624*b*. The pin 623 extends across a width of the receptacle 611. The pin 623 is coupled to two bosses 626*a*, 626*b* extending from the receptacle 611. The tracks 624*a*, 624*b* are formed in brackets 628*a*, 628*b* that are coupled to the tilt housing 616.

Figure 27:
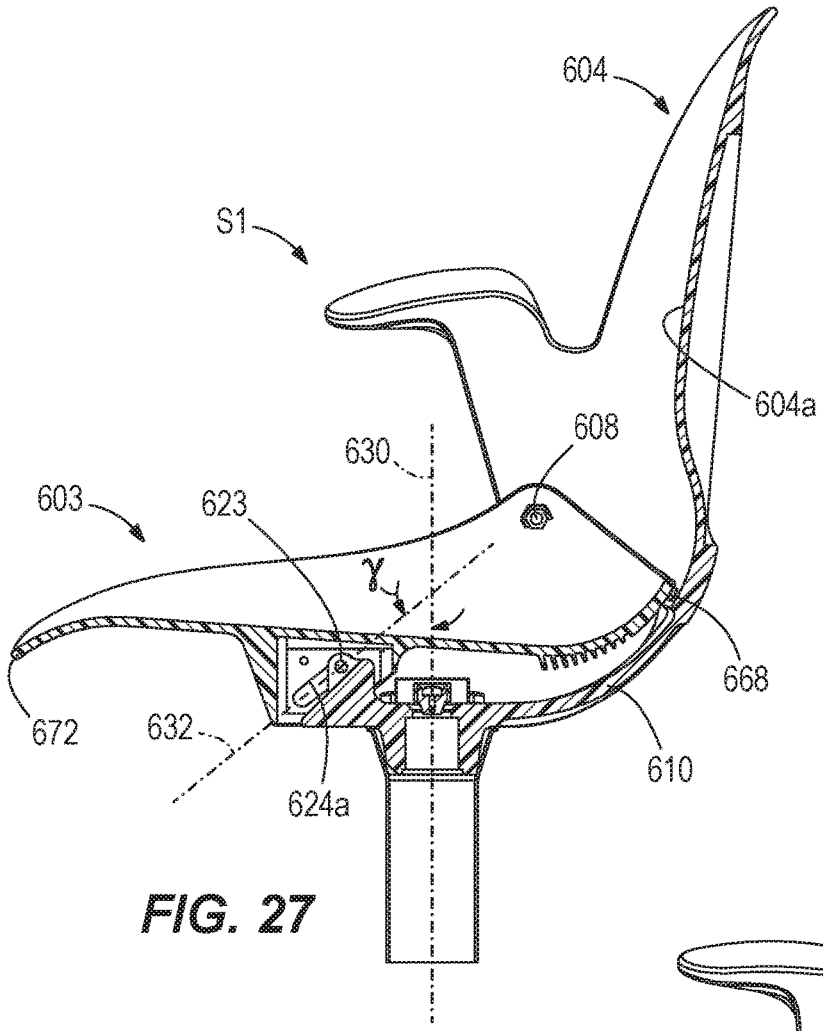
FIG. 27 is a cross-sectional view of the chair taken along section line 27-27 of FIG. 24 while in the upright position.

As shown in FIG. 27, the first track 624*a* extends along a longitudinal axis 632 that is oriented at an angle γ relative to the vertical axis 630. Similar to the first track 624*b*, the second track extends along a longitudinal axis that is also oriented at the angle γ relative to the vertical axis 630. The angle γ may be between about 40° and 70°. In some embodiments, the angle γ may be about 55°.

Figure 28:
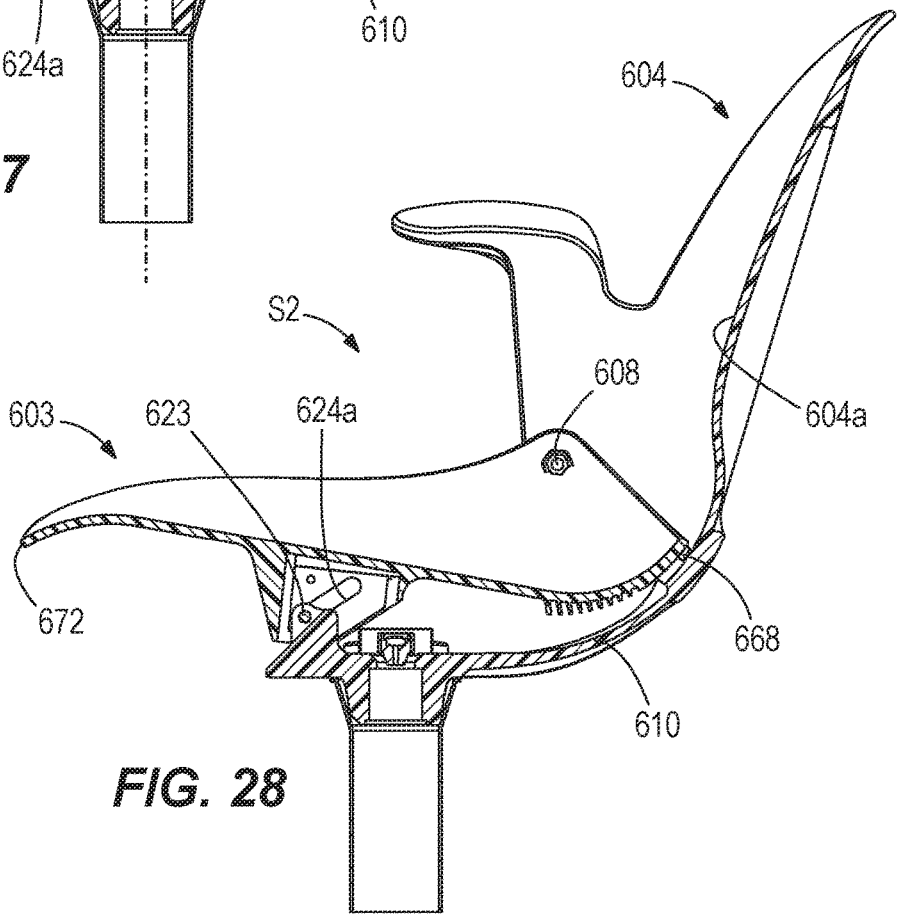
FIG. 28 is a cross-sectional view of the chair taken along section line 27-27 of FIG. 24 while in the backwardly inclined position.

As shown in FIGS. 27-28, the chair 601 is movable from an upright position S1 to a backwardly inclined position S2 when a force is applied to the back shell 604. The seat shell 603 and the back shell 604 define a first angle in the upright position S1 and a second angle in the backwardly inclined position S2. The second angle is greater than the first angle. Specifically, the second angle is greater than the first angle by more than 10°. In the backwardly inclined position S2, the back shell 604 is rotated clockwise about the pivot axis 640 (FIG. 24). In the backwardly inclined position S2, the seat shell 603 and the back shell 604 overlap to a greater degree than in the upright position S1.

The pin 623 is slidable in the first track 624*a* and in the second track 624*b* when the force is applied to the back shell 604. Each track defines a forward end and a rearward end. In the upright position S1 (FIG. 27), the pin 623 is adjacent rearward ends of the first track 624*a* and the second track 624*b*. When a force is applied to the back shell 604, the pin 623 moves towards forward ends of the first track 624*a* and the second track 624*b*. In the backwardly inclined position S2 (FIG. 28), the pin 623 is adjacent the forward ends of the first track 624*a* and the second track 624*b*.

When the chair 601 is in the backwardly inclined position S2, the extension 610 is elastically deformed in such a manner that the extension 610 generates a counter force to return the chair 601 to the upright position S1. In the upright position S1, the extension 610 is in an undeformed position. In the backwardly inclined position S2, the extension 610 is in a deformed position. The extension 610 is biased to move the chair 601 into the upright position S1.

Figure 29:
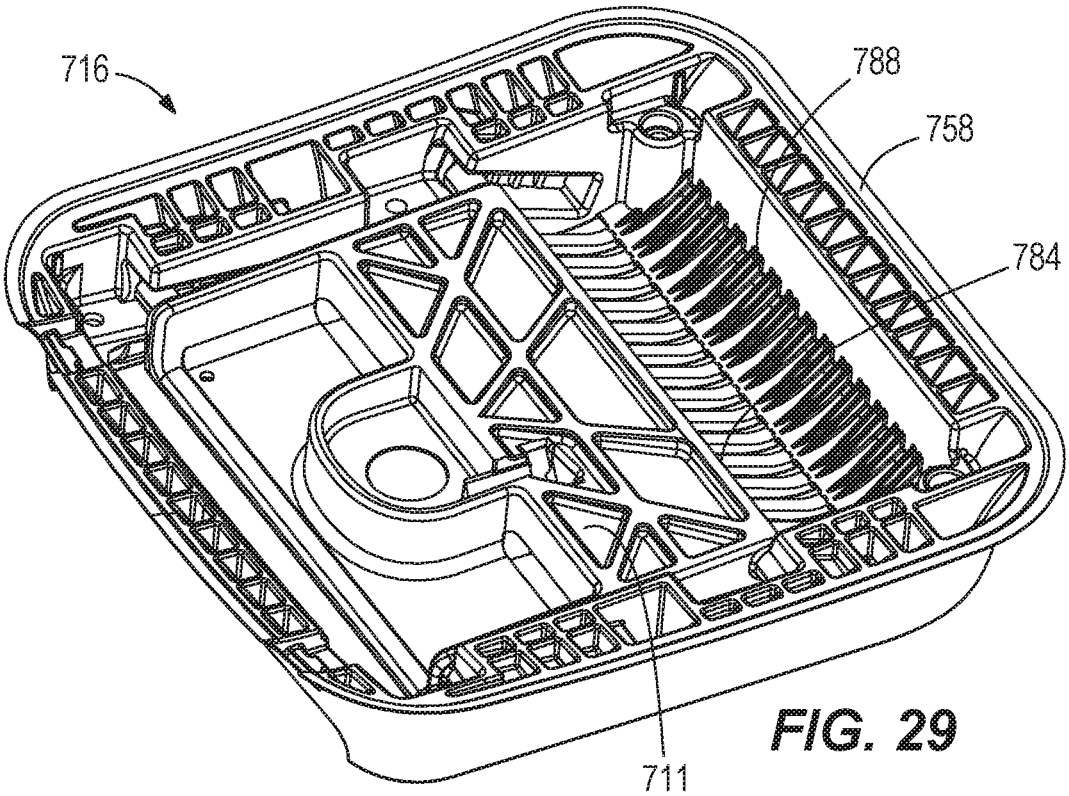
FIG. 29 is a top perspective view of a tilt housing and a receptacle for use with a chair according to some embodiments.
Figure 30:
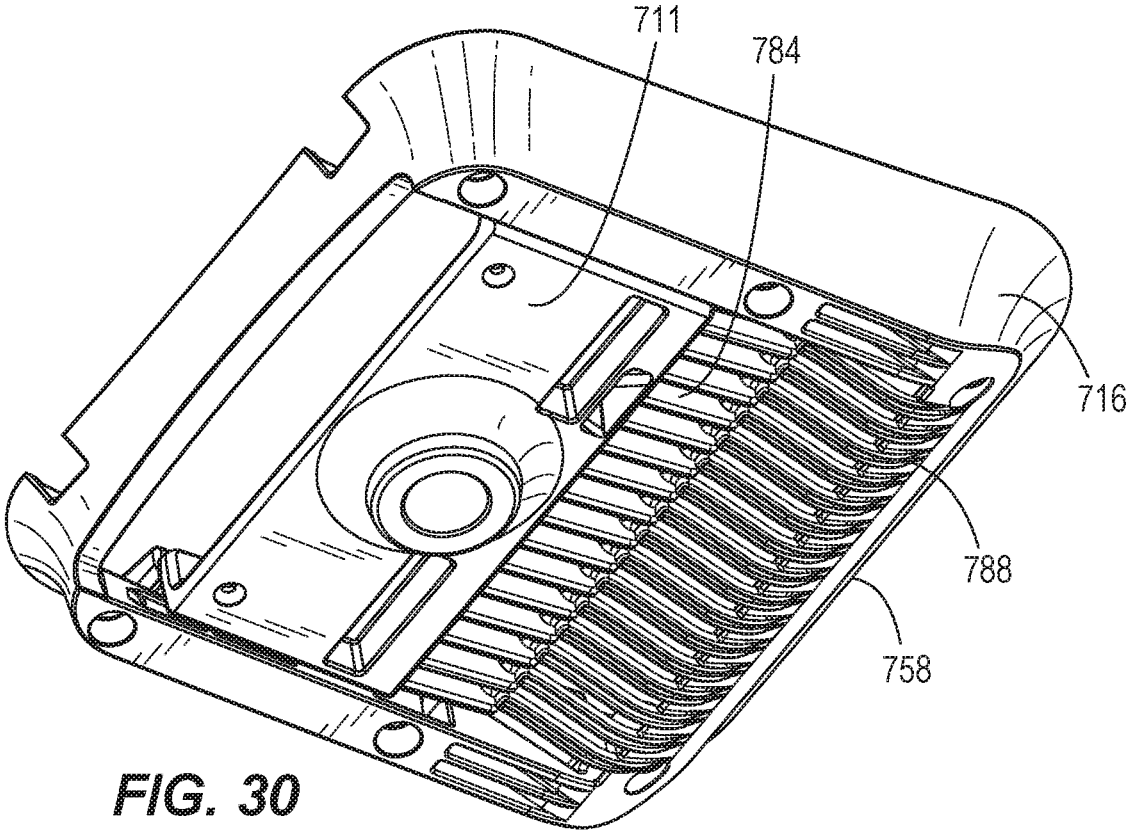
FIG. 30 is a bottom perspective view of the tilt housing and the receptacle shown in FIG. 29.

FIGS. 29-30 illustrate another receptacle 711 and tilt housing 716 for use with one of the chairs described above. The illustrated tilt housing 716 includes one or more ribs 788 extending toward the receptacle 711. The ribs 788 extend from a forward end 758 of the tilt housing 716. Each of the ribs 788 is spaced apart from each other. The receptacle 711 includes one or more slots 784. The slots 784 are formed on a bottom of the receptacle 711. The ribs 788 extend from a bottom of the tilt housing 716 to the slots 784. Each of the ribs 788 and each of the slots 784 have substantially the same width.

The slots 784 receive the ribs 788 as the tilt housing 716 moves relative to the receptacle 711 (e.g., as the chair moves from the upright position to the backwardly inclined position). The slots 784 and the ribs 788 cooperate to at least partially enclose a gap between the receptacle 711 and the tilt housing 716. In particular, the slots 784 and the ribs 788 inhibit relatively small objects (such as a user's fingers) from extending into the gap between the receptacle 711 and the tilt housing 716 and, thereby, becoming pinched as the chair moves between positions.

Figure 31:
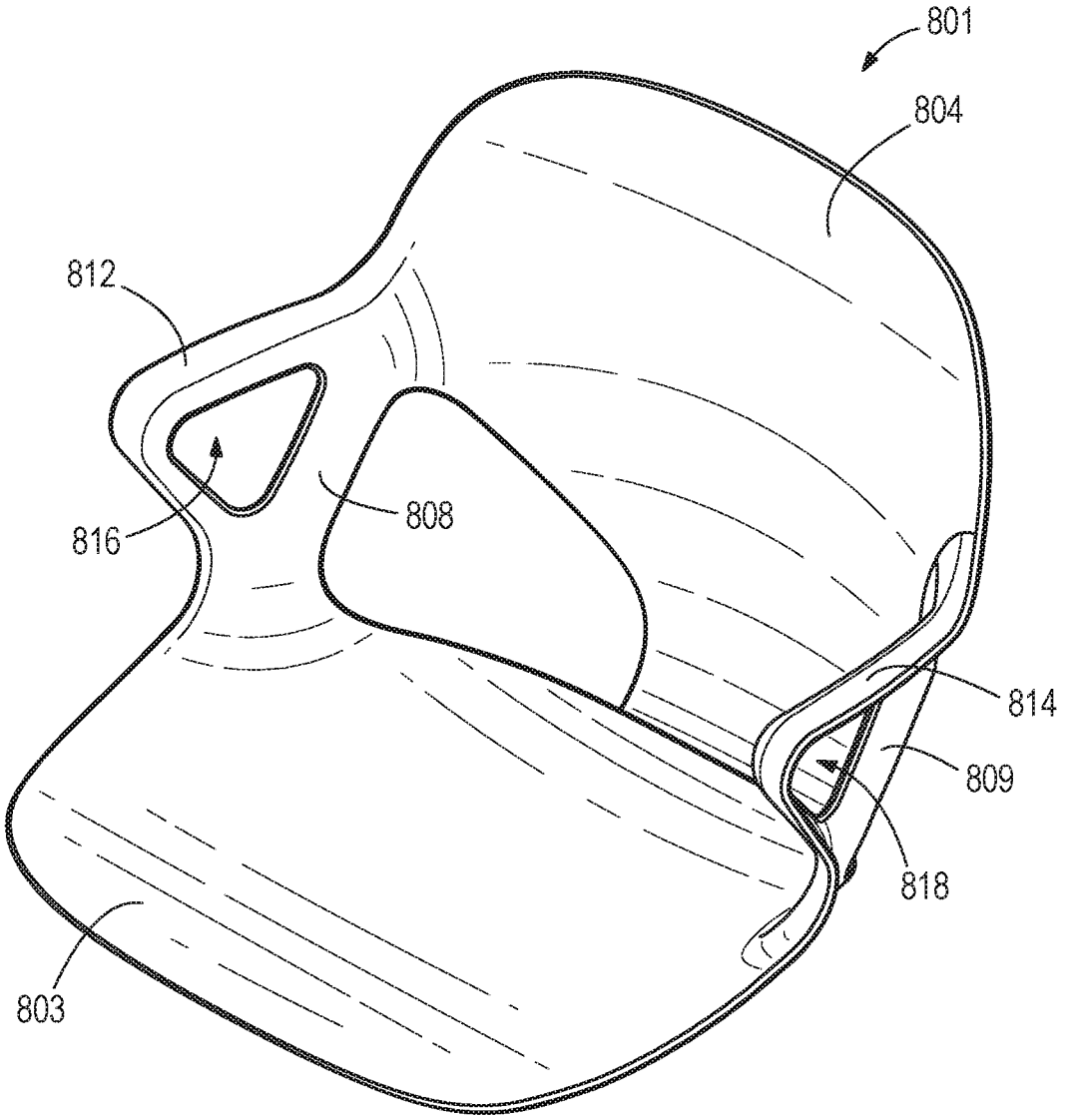
FIG. 31 is a perspective view of a supporting element for use with a chair.

FIG. 31 illustrates another supporting element 801 for use with one of the chairs described above, such as the chair 1, 401, or 501. For example, the supporting element 801 may be used with the chair 401 or the chair 501. The supporting element 801 includes a seat shell 803, a back shell 804, a first lateral connecting strut 808, and a second lateral connecting strut 809. In the illustrated embodiment, the supporting element 801 also includes two armrests 812, 814. The first armrest 812 extends from the first lateral connecting strut 808. The second armrest 814 extends from the second lateral connecting strut 809. In the illustrated embodiment, the armrests 812, 814 are integrally formed as a single piece with the connecting struts 808, 809 and with the seat shell 803 and the back shell 804. In other embodiments, the armrests 812, 814 may be separate pieces that are permanently or removably coupled to the connecting struts 808, 809. The illustrated armrests 812, 814 are generally triangular in shape. Each armrest 812, 814 defines a central opening 816, 818. In other embodiments, the armrests 812, 814 may have other configurations.

Various features and advantages of the invention are set forth in the following claims.

What is claimed is:

1. A chair comprising:

a base;

a receptacle coupled to an upper end of the base;

a seat shell forming a seat surface and having a front edge and a rear edge, the seat shell supported by the receptacle;

a back shell forming a back surface configured to engage a user, the back shell connected to the seat shell on both sides of the seat surface and on both sides of the back surface, the back shell including an extension extending from the back surface to the receptacle under the seat shell, the extension being elastically deformable;

a first lateral connecting strut spaced apart from the extension and connecting a first side of the seat shell to a first side of the back shell; and a second lateral connecting strut spaced apart from the extension and connecting a second side of the seat shell to a second side of the back shell;

wherein the rear edge of the seat shell is spaced apart from the back surface of the back shell to form a gap therebetween; and wherein the extension is positioned between the first lateral connecting strut and the second lateral connecting strut.

2. The chair of claim 1, wherein the seat shell and the back shell are connected in an articulated manner to each other on both sides of the seat surface and on both sides of the back surface by two joints.

3. The chair of claim 1, wherein the seat shell and the back shell are integrally formed as a single piece.

4. The chair of claim 1, wherein the back shell and the extension are integrally formed a single piece.

5. The chair of claim 1, wherein the base includes a carrying pillar having the upper end and a lower end, a plurality of feet extending radially outward from the lower end of the carrying pillar, and a caster coupled to each foot.

6. The chair of claim 1, wherein the base includes a plurality of legs.

7. The chair of claim 1, wherein the receptacle includes a first pin and a second pin, the first pin positioned adjacent a forward end thereof, the second pin positioned adjacent a rearward end thereof.

8. The chair of claim 7, further comprising a tilt housing secured to the bottom surface of the seat shell, wherein the base defines a vertical axis, and wherein the tilt housing defines a first track that receives the first pin and a second track that receives the second pin, the first track extending along a first longitudinal axis that is oriented at a first angle relative to the vertical axis, the second track extending along a second longitudinal axis that is oriented at a second angle relative to the vertical axis, the second angle being different than the first angle.

9. The chair of claim 8, wherein the first pin is slidable in the first track and the second pin is slidable in the second track when a force is applied to the back shell.

10. The chair of claim 9, wherein the seat surface rises as the first pin slides in the first track and the second pin slides in the second track.

11. The chair of claim 8, further comprising a first bearing coupled to the first pin and positioned within the first track, and a second bearing coupled to the second pin and positioned within the second track.

12. The chair of claim 11, wherein each of the first bearing and the second bearing has a square cross-sectional shape.

13. The chair of claim 8, wherein the first pin and the second pin are located on a first side of the receptacle, wherein the receptacle includes a third pin and a fourth pin located on a second side of the receptacle that is opposite the first side, the third pin positioned adjacent the forward end thereof, the fourth pin positioned adjacent the rearward end thereof, and wherein the tilt housing defines a third track that receives the third pin and a fourth track that receives the fourth pin, the third track extending along a third longitudinal axis that is oriented at the first angle relative to the vertical axis, the fourth track extending along a fourth longitudinal axis that is oriented at the second angle relative to the vertical axis.

14. The chair of claim 8, wherein the tilt housing includes one or more ribs extending toward the receptacle, and wherein the receptacle includes one or more slots that receive the ribs as the tilt housing moves relative to the receptacle.

15. The chair of claim 1, wherein the extension has a distal end opposite from the back surface, and wherein the distal end is fastened to the receptacle.

16. The chair of claim 15, wherein the rear edge of the seat shell is spaced a first distance from the back surface of the back shell when in the upright position, and wherein the rear edge of the seat shell is spaced a second distance from the back surface of the back shell when in the backwardly inclined position, the first distance being greater than the second distance.

17. The chair of claim 15, wherein the seat surface rises as the chair moves from the upright position to the backwardly inclined position such that a user seated on the seat surface generates a second counter force to return the chair to the upright position.

18. The chair of claim 1, wherein the chair is movable from an upright position to a backwardly inclined position when a force is applied to the back shell, wherein in the backwardly inclined position, the extension is elastically deformed in such a manner that the extension generates a counter force to return the chair to the upright position.

19. A chair comprising:

a base defining a vertical axis;

a receptacle coupled to an upper end of the base;

a seat shell forming a seat surface and a bottom surface; and a back shell forming a back surface, the back shell including an extension extending from the back surface to the receptacle under the seat shell; and a tilt housing secured to the bottom surface of the seat shell;

wherein either the receptacle or the tilt housing includes a first pin and a second pin, the first pin positioned adjacent a forward end thereof, the second pin positioned adjacent a rearward end thereof;

wherein the other of the receptacle or the tilt housing defines a first track that receives the first pin and a second track that receives the second pin, the first track extending along a first longitudinal axis that is oriented at a first angle relative to the vertical axis, the second track extending along a second longitudinal axis that is oriented at a second angle relative to the vertical axis, the second angle being different than the first angle;

wherein the chair is movable from an upright position to a backwardly inclined position when a force is applied to the back shell, wherein in the backwardly inclined position, the extension is elastically deformed in such a manner that the extension generates a counter force to return the chair to the upright position.

20. The chair of claim 19, wherein the first pin is slidable in the first track and the second pin is slidable in the second track when a force is applied to the back shell.

21. The chair of claim 20, wherein the seat surface rises as the first pin slides in the first track and the second pin slides in the second track.

22. The chair of claim 19, further comprising a first bearing coupled to the first pin and positioned within the first track, and a second bearing coupled to the second pin and positioned within the second track.

23. The chair of claim 19, wherein the first pin and the second pin are located on a first side of either the receptacle or the tilt housing, wherein either the receptacle or the tilt housing includes a third pin and a fourth pin located on a second side opposite the first side, the third pin positioned adjacent the forward end thereof, the fourth pin positioned adjacent the rearward end thereof, and wherein the other of the receptacle or the tilt housing defines a third track that receives the third pin and a fourth track that receives the fourth pin, the third track extending along a third longitudinal axis that is oriented at the first angle relative to the vertical axis, the fourth track extending along a fourth longitudinal axis that is oriented at the second angle relative to the vertical axis, the third angle being different than the fourth angle.

24. The chair of claim 19, wherein the seat surface rises as the chair moves from the upright position to the backwardly inclined position such that a user seated on the seat surface generates a second counter force to return the chair to the upright position.

25. A chair comprising:

a base;

a receptacle coupled to an upper end of the base, the receptacle including a first pin adjacent a first end thereof and a second pin adjacent a second end thereof;

a seat shell forming a seat surface and a bottom surface;

a back shell forming a back surface, the back shell including an extension integrally formed as a single piece with the back surface and extending from the back surface to the receptacle under the seat shell, the extension being elastically deformable;

a first lateral connecting strut spaced apart from the extension and connecting a first side of the seat shell to a first side of the back shell;

a second lateral connecting strut spaced apart from the extension and connecting a second side of the seat shell to a second side of the back shell; and a tilt housing secured to the bottom surface of the seat shell, the tilt housing having a first track that receives the first pin and a second track that receives the second pin, the first track extending along a first longitudinal axis that is oriented at a first angle relative to the vertical axis, the second track extending along a second longitudinal axis that is oriented at a second angle relative to the vertical axis, the second angle being different than the first angle; wherein the seat shell is movable relative to the back shell along a path defined by the first track and the second track.

26. The chair of claim 25, wherein the chair is movable from an upright position to a backwardly inclined position when a force is applied to the back shell, wherein in the backwardly inclined position, the extension is elastically deformed in such a manner that the extension generates a counter force to return the chair to the upright position.

27. The chair of claim 26, wherein the seat surface rises as the chair moves from the upright position to the backwardly inclined position such that a user seated on the seat surface generates a second counter force to return the chair to the upright position.

28. The chair of claim 25, wherein a rear edge of the seat shell is spaced a first distance from the back surface of the back shell when in the upright position, and wherein the rear edge of the seat shell is spaced a second distance from the back surface of the back shell when in the backwardly inclined position, the first distance being greater than the second distance.

* * * * *